US009873190B2

(12) United States Patent
Bruno

(10) Patent No.: US 9,873,190 B2
(45) Date of Patent: Jan. 23, 2018

(54) FASTENER HOLDING DEVICE

(71) Applicant: Dillon Bruno, Inglewood, CA (US)

(72) Inventor: Dillon Bruno, Inglewood, CA (US)

( * ) Notice: Subject to any disclaimer, the term of this patent is extended or adjusted under 35 U.S.C. 154(b) by 321 days.

(21) Appl. No.: 14/678,162

(22) Filed: Apr. 3, 2015

(65) Prior Publication Data

US 2015/0321329 A1 Nov. 12, 2015

Related U.S. Application Data

(60) Provisional application No. 62/058,354, filed on Oct. 1, 2014, provisional application No. 61/975,459, filed on Apr. 4, 2014.

(51) Int. Cl.
*B25C 3/00* (2006.01)
*B25B 23/10* (2006.01)

(52) U.S. Cl.
CPC ..... *B25C 3/008* (2013.01); *B25B 23/101* (2013.01)

(58) Field of Classification Search
None
See application file for complete search history.

(56) References Cited

U.S. PATENT DOCUMENTS

| | | | |
|---|---|---|---|
| 983,798 | A | 2/1911 | Angell |
| 1,109,507 | A | 9/1914 | Bostock et al. |
| 1,460,294 | A | 6/1923 | Wegner et al. |
| 1,575,582 | A | 3/1926 | Joy et al. |
| 1,776,646 | A | 9/1930 | Wilson et al. |
| 2,349,339 | A | 5/1944 | Cloer et al. |
| 2,420,869 | A | 5/1947 | Dell et al. |
| 2,652,082 | A | 9/1953 | Zanelli et al. |
| 2,657,382 | A | 11/1953 | Lueneburg et al. |
| 3,060,440 | A | 10/1962 | Pfaff et al. |
| 3,147,484 | A | 9/1964 | Nelson et al. |
| 3,695,499 | A | 10/1972 | Taylor et al. |
| 3,919,903 | A | 11/1975 | McAlister |
| 4,029,135 | A | 6/1977 | Searfoss, Jr. |
| 4,054,237 | A | 10/1977 | Rietveld |
| 4,179,058 | A | 12/1979 | Yost |

(Continued)

FOREIGN PATENT DOCUMENTS

| | | |
|---|---|---|
| EP | 0196545 | 10/1986 |
| GB | 189729395 | 10/1898 |

(Continued)

OTHER PUBLICATIONS

Printout of webpage at http://toolmonger.com/2009/12/10/the-nail-holder-is-this-a-good-tool/ on Aug. 12, 2014.

(Continued)

*Primary Examiner* — Joseph J Hail
*Assistant Examiner* — Brian Keller
(74) *Attorney, Agent, or Firm* — Joseph G. Swan, P.C.

(57) ABSTRACT

Provided is, among other things, an apparatus for holding a fastener, which includes: a main body structure; and a fastener holding member rotatably attached to the main body structure, such that the fastener holding member is capable of rotating relative to the main body structure around a rotation axis. The fastener holding member also includes a pair of notches on opposite sides of the rotation axis, which are sized and shaped to accommodate a fastener, such as a nail or a screw.

23 Claims, 48 Drawing Sheets

(56) References Cited

U.S. PATENT DOCUMENTS

| | | | | |
|---|---|---|---|---|
| 4,201,258 | A | 5/1980 | Elmore et al. | |
| 4,221,248 | A | 9/1980 | Rix | |
| 4,403,725 | A | 9/1983 | Lawrence | |
| 4,437,602 | A | 3/1984 | Kaczmarek | |
| 4,631,985 | A | 12/1986 | Roberts | |
| 4,676,424 | A | 6/1987 | Meador et al. | |
| 4,784,025 | A * | 11/1988 | Peck | B25C 3/008 81/44 |
| 4,843,923 | A | 7/1989 | Voss | |
| 4,926,718 | A | 5/1990 | Cook | |
| 5,375,488 | A | 12/1994 | Baitner | |
| 5,529,234 | A | 6/1996 | Juneau | |
| 6,088,862 | A | 7/2000 | Bulcock | |
| 6,122,788 | A | 9/2000 | Bulcock | |
| 6,352,009 | B1 | 3/2002 | Gaidjiergis | |
| 6,925,909 | B2 * | 8/2005 | Crosby | B25B 9/02 81/44 |
| 6,951,153 | B2 | 10/2005 | Berthlaume | |
| 7,013,516 | B1 | 3/2006 | Peters | |
| 7,056,322 | B2 | 6/2006 | Davison et al. | |
| 7,100,475 | B1 | 9/2006 | Rufolo, Jr. | |
| 7,628,304 | B2 | 12/2009 | Yamamoto et al. | |
| 7,779,730 | B2 | 8/2010 | Jones | |
| 7,963,193 | B2 | 6/2011 | Morgan | |
| 8,479,612 | B2 | 7/2013 | Sergyeyenko et al. | |
| 2004/0035255 | A1 | 2/2004 | Rion | |
| 2005/0166713 | A1 | 8/2005 | Lloyd | |
| 2006/0101948 | A1 | 5/2006 | Meitzler et al. | |
| 2010/0132514 | A1 | 6/2010 | Morgan | |
| 2010/0154598 | A1 | 6/2010 | Sergyeyenko et al. | |
| 2011/0174116 | A1 | 7/2011 | Lin | |
| 2014/0158739 | A1 * | 6/2014 | Grazioli | B25H 1/0021 227/129 |

FOREIGN PATENT DOCUMENTS

| | | |
|---|---|---|
| GB | 805925 | 12/1958 |
| WO | WO2005105385 | 11/2005 |

OTHER PUBLICATIONS

Printout of webpage at http://toolmonger.com/2009/06/02/olympia-tools-nail-holding-hammer/ on Aug. 12, 2014.

Printout of webpage at http://www.starcrest.com/product/garden+and+tools/tools/nailguide.do on Aug. 12, 2014.

International Search Report and Written Opinion in corresponding PCT application No. PCT/US2015/024211.

* cited by examiner

FASTENER HOLDING DEVICE

This application claims the benefit of U.S. Provisional Patent Application Ser. No. 62/058,354 (filed on Oct. 1, 2014) and 61/975,459 (filed on Apr. 4, 2014), which applications are incorporated by reference herein as though set forth herein in full.

FIELD OF THE INVENTION

The present invention concerns a tool or other device that can be used to hold a fastener, such as a nail or screw, while it is being pounded, screwed or otherwise inserted to a wall or other surface.

BACKGROUND

There currently exists a variety of different kinds of devices for holding a nail while it is being pounded into a wall or other surface. However, each of such devices has its own limitations and/or drawbacks.

SUMMARY OF THE INVENTION

The present invention provides improved tools and other devices for holding a fastener, such as a nail or a screw, which provide the user with greater flexibility and/or are easier to use than conventional devices.

According to one representative set of embodiments (sometimes referred to herein as the "tool-adapter embodiments"), a device according to the present invention attaches to the jaws of a wrench, pliers or other existing tool, in which case it preferably may be readily detached from such other tool as and when desired. In an alternative set of embodiments (sometimes referred to herein as the "standalone embodiments"), a dedicated holding device is provided, e.g., having a permanently attached handle and/or main body structure.

In either case, a device according to the present invention often can be useful for inserting a fastener into a wall or other substrate where, e.g., it might otherwise be difficult to place a nail gun or a screw gun, or where it might be impractical or undesirable to hold a fastener by hand. In addition, the present device can allow the user to avoid having his or her hands near the point of contact between a hammer and nail or a screwdriver and screw. In short, the preferred embodiments can enable one to safely, precisely and/or easily place and then drive a fastener.

A tool-adapter fastener holding device according to the present invention may be comprised of two pieces or just a single piece and can be made from a variety of materials (such as metal, plastic or a combination of several materials). In the following discussion, the fastener generally is assumed to be a nail. However, screws or other types of fasteners instead may be used. Thus, any references herein to a nail can be replaced with references to a different type of fastener.

As noted above, a device for holding a fastener while it is inserted into a wall or other surface or substrate can be provided as a standalone tool or as an attachment to an existing tool. In the latter case, at least one component of the device preferably is provided with a surface that engages with a jaw of the existing tool, and also may be provided with a means, such as a screw and/or magnet, for securing the component to the tool's jaw.

Preferably, a device according to the present invention is provided with at least one surface that makes contact with the wall or other surface in operational use, allowing the device to be steadied relative to it and permitting more accurate placement and orientation of the fastener. Various aspects of the invention may be used or omitted and/or combined in different ways to provide different embodiments. For instance, in the preferred embodiments, the portion of the device that actually holds the fastener is capable of rotating or pivoting (e.g., freely rotating) relative to the portion that is secured to the existing tool or, in the case of a standalone tool, relative to the tool's handle. In this way, the fastener can be positioned as desired and then remain steady while the tool's handle is manipulated into a more convenient orientation.

According to another aspect of the invention, one or more features are provided for holding the fastener at different desired angles relative to the wall or other surface. One such feature is to use a holding mechanism that includes a plurality of notches, with each notch (or pair of notches) capable of holding a fastener at a different angle relative to the wall-contacting surface. Another means is to provide the holding element with an additional rotating mechanism that allows the fastener-holding member to be rotated to a desired angle, preferably with a locking mechanism that allows the fastener-holding member to be locked into place after rotating it to the desired angle. The foregoing features can be provided separately or combined together, depending upon the desired embodiment.

Thus, one particular embodiment of the invention is directed to an apparatus for holding a fastener, which includes: a main body structure; and a fastener holding member rotatably attached to the main body structure, such that the fastener holding member is capable of rotating relative to the main body structure around a rotation axis. The fastener holding member also includes a pair of notches on opposite sides of the rotation axis, which are sized and shaped to accommodate a fastener, such as a nail or a screw. In a more particular embodiment, the rotatable fastener holding member is part of a larger structure that is capable of pivoting relative to the remainder of the apparatus.

By virtue of the foregoing arrangement, it typically is possible to pound a nail (or otherwise insert other types of fasteners) at a desired angle and without the user having to hold the fastener with his or her fingers during the process. Such an apparatus can be provided as a standalone tool or can be configured for attaching to an existing tool. In addition, such an apparatus can be constructed to accommodate a wide variety of different sizes and types of fasteners.

The foregoing summary is intended merely to provide a brief description of certain aspects of the invention. A more complete understanding of the invention can be obtained by referring to the claims and the following detailed description of the preferred embodiments in connection with the accompanying figures.

BRIEF DESCRIPTION OF THE DRAWINGS

In the following disclosure, the invention is described with reference to the attached drawings. However, it should be understood that the drawings merely depict certain representative and/or exemplary embodiments and features of the present invention and are not intended to limit the scope of the invention in any manner. The following is a brief description of each of the attached drawings.

DESCRIPTION OF THE PREFERRED EMBODIMENT(S)

Figure 1:
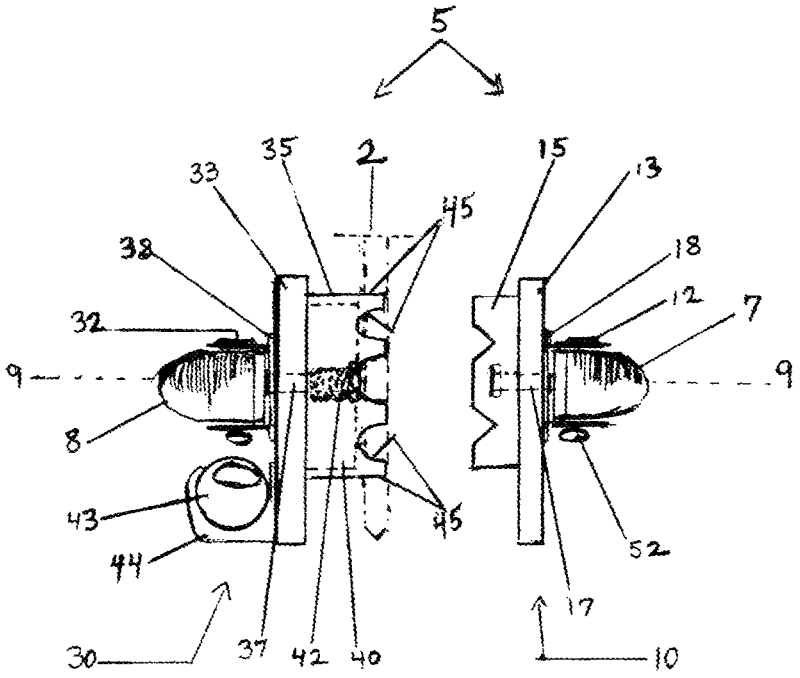
FIG. 1 is a side elevational view of a two-component fastener-holding device according to the present invention.
Figure 2:
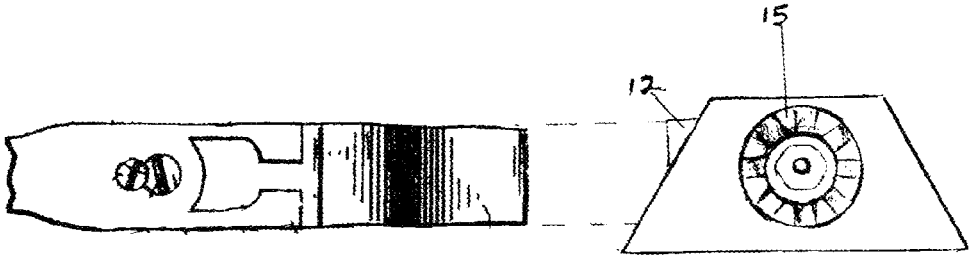
FIG. 2 is a first side elevational view showing one component of the two-component device being installed onto the jaw of an existing tool.
Figure 3:
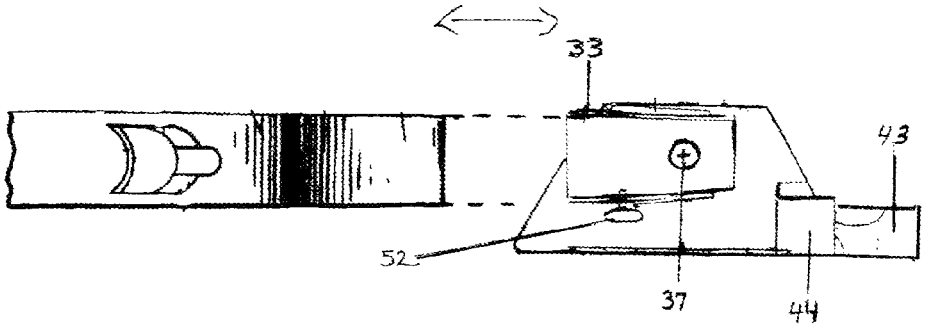
FIG. 3 is an opposite side elevational view showing a component of the two-component device being installed onto the jaw of an existing tool.
Figure 4:
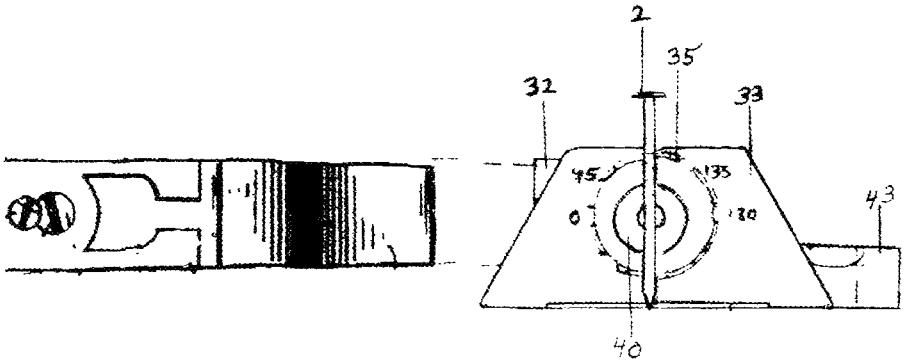
FIG. 4 is a first side elevational view showing a component of the two-component device holding a fastener and being installed onto the jaw of an existing tool.
Figure 5A:
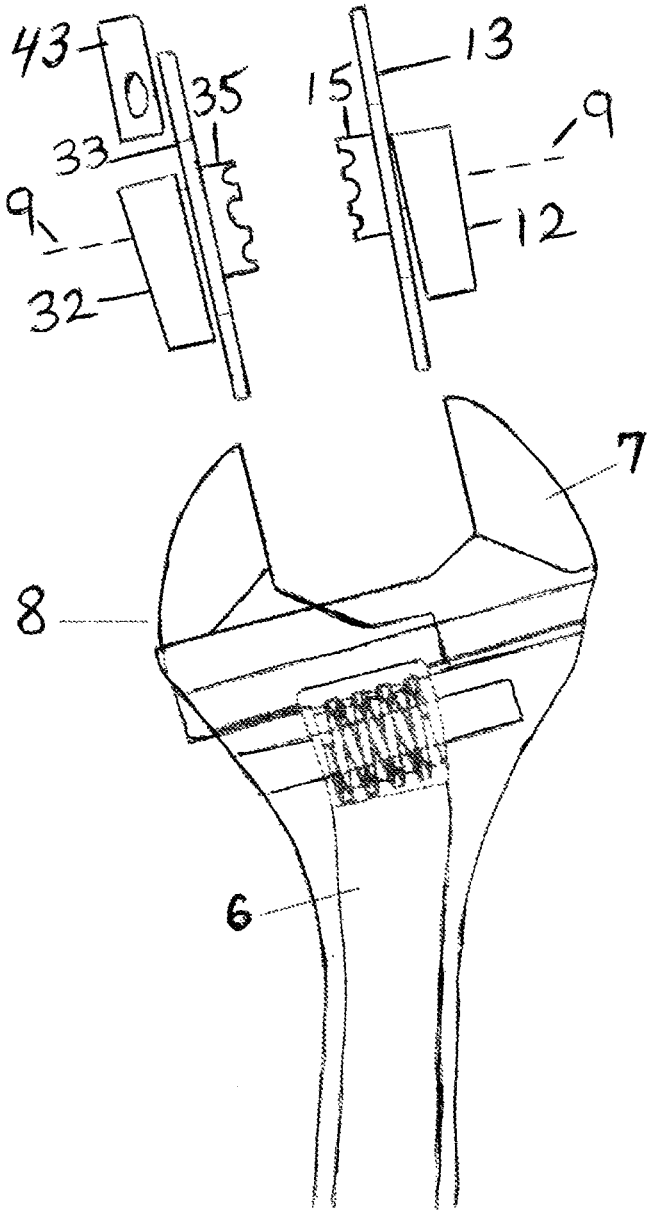
FIG. 5A is a top plan view showing the components of the two-component device being installed onto the jaws of an existing tool.
Figure 5B:
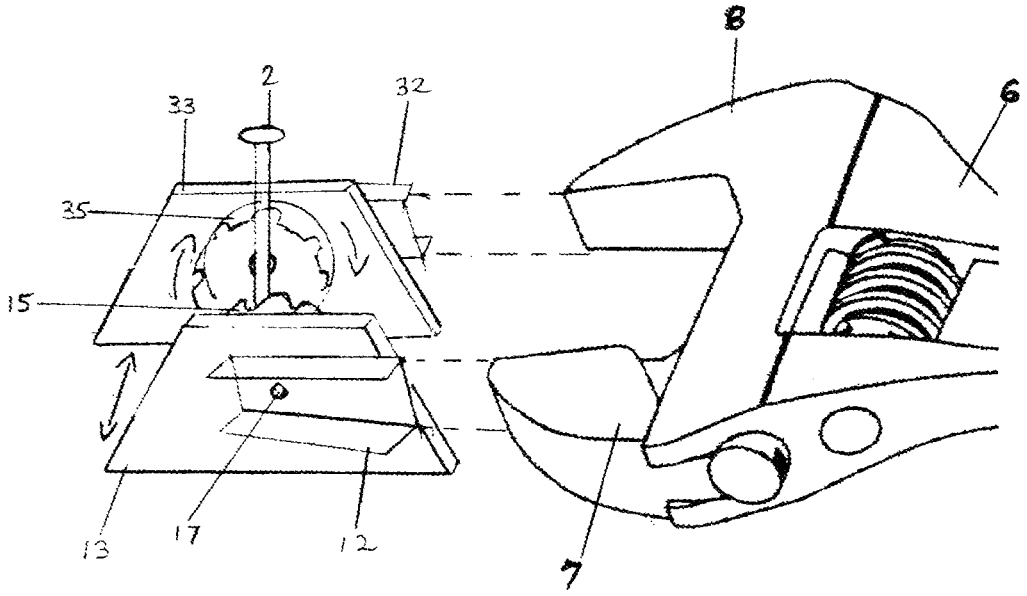
FIG. 5B is a perspective view showing the components of the device being installed onto the jaws of the tool.

For ease of reference, the present disclosure is divided into sections. The general subject matter of each section is indicated by that section's heading.

Two-Piece Tool-Adapter Devices.

One example of a two-piece tool-adapter device 5 is illustrated in FIGS. 1-13. As shown, device 5 includes a first component 10 and a second component 30, which are capable of detachably attaching to the jaws 7 and 8 of a wrench, pliers or other tool, as described in greater detail below. In the following discussion, device 5 is configured for attaching to an adjustable wrench 6. However, it will be readily apparent that minor modifications will provide similar devices that are adapted for attaching to pliers (e.g., long-handle pliers, channel locks or parallel jaw pliers) or other tools. Thus, references to wrench 6 below can be replaced, for alternate embodiments, with references to a different type of tool.

Component 10 includes a jaw-engaging member 12 that preferably is configured (e.g., sized and shaped) for attaching to a jaw 7 of a tool, and which may be magnetic and/or may be provided with a separate attached magnet or screw for securing component 10 to jaw 7. The outer surface of a support plate 13 is attached to the jaw-engaging member 12 and, in the preferred embodiments, the two are pivotally attached to each other such that the support plate 13 is capable of pivoting or swiveling around axis 9 (which typically is perpendicular to the jaws 7 and 8), in relation to the jaw-engaging member 12. A fastener holding member 15, which preferably is magnetic, includes one or more recesses or notches for receiving and accommodating the shaft of a fastener and is attached to the inner surface of the support plate 13. In certain embodiments, fastener holding member 15 is capable of rotating relative to support plate 13. An attachment member 17 (such as a pin, screw, nut, bolt, or the like) secures the jaw-engaging member 12, support plate 13, and fastener holding member 15, and a spacing member 18 (such as a washer or the like) which provides clearance between the jaw-engaging member 12 and the support plate 13. Although discussed separately, two or more of the foregoing elements may be integrated into a single element.

Similarly, component 30 includes a jaw-engaging member 32 for attaching to the other jaw 8 of the tool, a support plate 33, a fastener holding member 35, an attachment member 37, and a spacing member 38. Preferably, the same considerations that apply to elements 12, 13, 15, 17 and 18 above also apply to elements 32, 33, 35, 37 and 38, respectively. In addition, component 30 preferably is provided with a magnet 40 that can be housed inside the fastener holding member 35 to hold the fastener 2 in place and a spring 42 that provides tension between the fastener holding member 35 and the second, inner surface of the support plate 33. As discussed in greater detail below, this spring 42 allows the fastener holding member 35 to be manually or mechanically disengaged, rotated parallel to the second surface of support plate 33 (around axis 9) to any desired position (−360° to)+360°, and then released to lock into place at that new position. Finally, also included on component 30 is a mini level 43 that is attached to the first, outer surface of the support plate by means of a plastic or metal holder 44 (e.g., a snap-fit holder). This holder 44 is open-ended allowing the level 43 to be removed and replaced as desired. Although discussed separately, two or more of the foregoing elements may be integrated into a single element.

Figure 6:
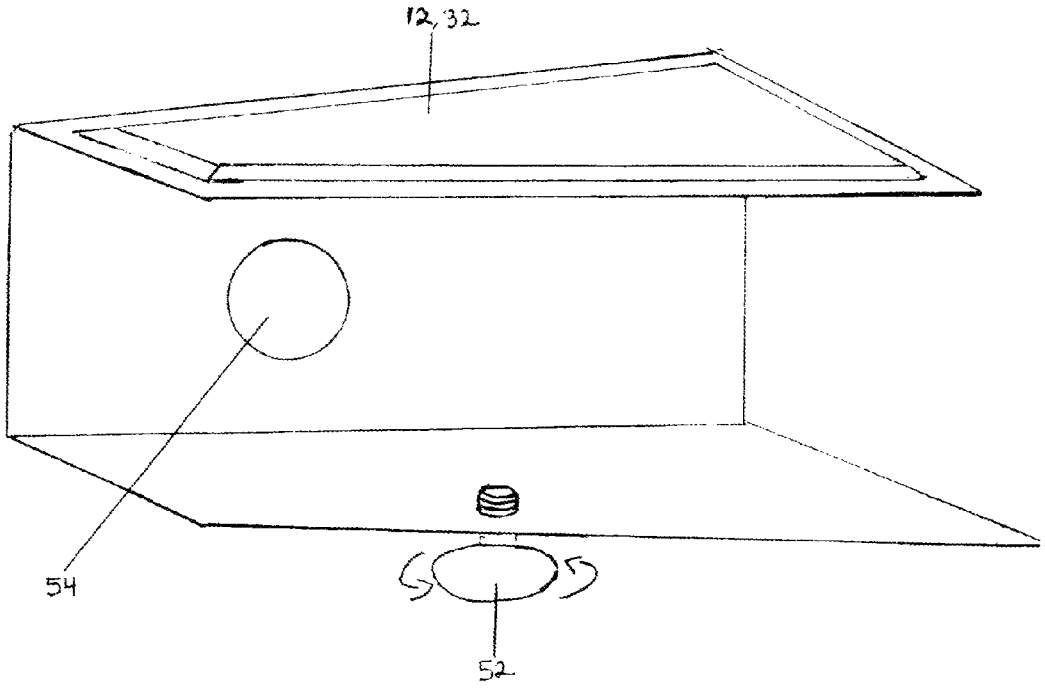
FIG. 6 is a perspective view of a jaw-engaging member of a device according to the present invention.

As shown, the jaw-engaging members 12 and 32 are sized and shaped to fit over the jaws 7 and 8, respectively, of a wrench 6. In addition, in the preferred embodiments a means for more securely attaching members 12 and 32 to jaws 7 and 8 is provided. For example, as shown in FIG. 6, the jaw-engaging members 12 and/or 32 can be provided with a screw 52 (such as a butterfly screw, knob screw or the like) that secures the respective jaw-engaging member 12 and/or 32 to its corresponding jaw 7 or 8. In the particular embodiment shown, each jaw-engaging member 12 and 32 has three roughly perpendicular panels, forming a channel that fits over the corresponding jaw 7 or 8. The channel in the illustrated embodiment is trapezoidally shaped in cross-section to match the trapezoidal shape of the jaws 7 and 8 of a wrench 6. However, other shapes may be used, e.g., depending on the shape of the jaws of the particular wrench, pliers or other tool to which the device is to be attached. In addition, or instead, each jaw-engaging member 12 and/or 32 may be magnetic, or may have a magnet attached to it, to aid in securing it to the metal jaws of the wrench or other intended tool.

In the present particular embodiment, the portion of the trapezoidal jaw-engaging member 12 and/or 32 parallel to the outer surface of support plates 13 and 33 have a short end width of about 0.415 inches and a long end width of about 0.565 inches. The length of the trapezoidal jaw-engaging member 12 and/or 32 is approximately 1 inch. The widths of the portions of the jaw-engaging member 12 and/or 32 perpendicular to support plates 13 and 33 are approximately 0.370 inch near the short end and approximately 0.305 inch near the long end. In a preferred embodiment, as shown in FIG. 6, there is an aperture 54 in the portion of the jaw-engaging members 12 and 32, parallel to the second, outer surface of support plates 13 and 33 having a diameter of approximately 0.180 inches for placement of the attachment member 37 to connect the jaw-engaging member(s) to the support plate(s).

The support plates 13 and 33 can be of a variety of different shapes and sizes. In the embodiment shown, the support plates 13 and 33 are trapezoidal in shape, having a height of approximately 1 inch, a base 48 length of approximately 2 inches, a top 49 length of approximately 0.9 inch, and the thickness of approximately 0.2 inch. In operational use, the bases of the support plates 13 and 33 are placed against a wall or other surface to keep the fastener positioned and stable with respect to such surface.

Figure 7:
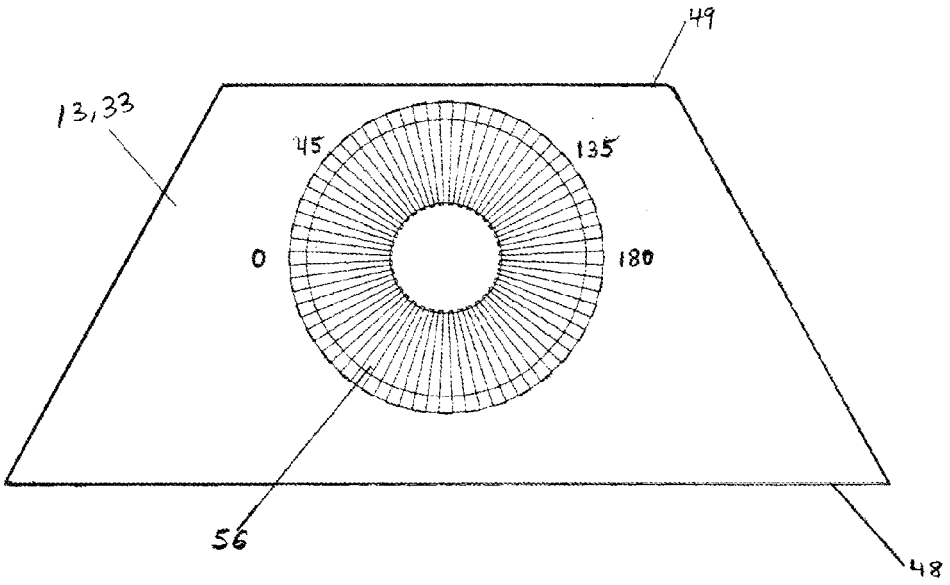
FIG. 7 is a top plan view of the inner surface of a trapezoidally shaped support plate with ridges for a device according to the present invention.
Figure 8:
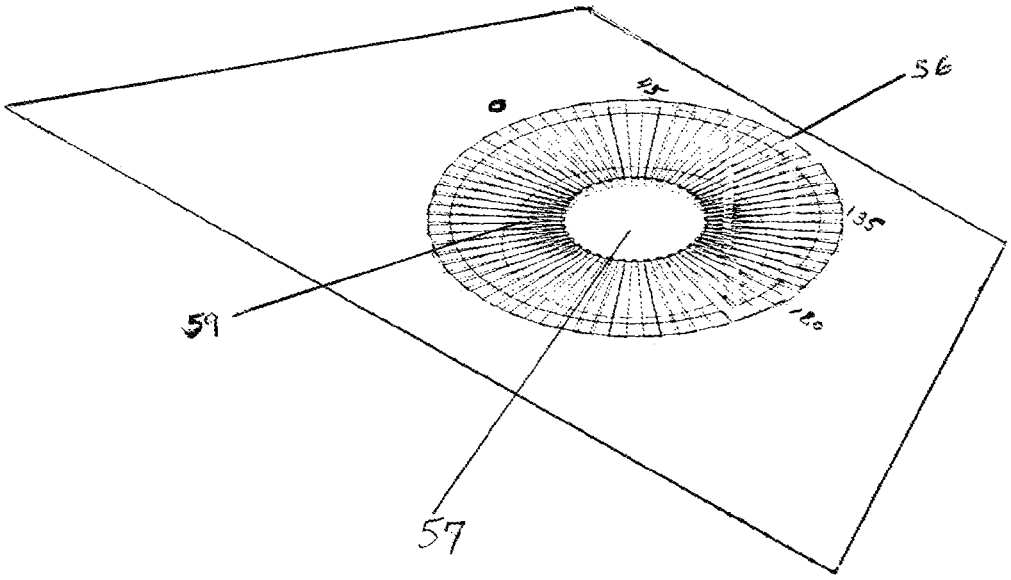
FIG. 8 is a perspective view of the inner surface of a trapezoidally shaped support plate with ridges for a device according to the present invention.

In the present embodiment, the inner surface of support plate 13 and/or support plate 33 is provided with a circular indentation well 56 having radially oriented alternating ridges and grooves, as shown in FIGS. 7 and 8. In the preferred embodiments, the diameter of this circular indentation well 56 is approximately 0.725 inch, its depth extends to 0.070 inch, and it includes 72 equidistant, linear ridges that extend from a central portion of the circular indentation 56 to the edges of the circle, resulting in 5° angular increments. The ridges preferably all have equal heights and depths between them. In other embodiments these angular increments can vary.

Figure 9:
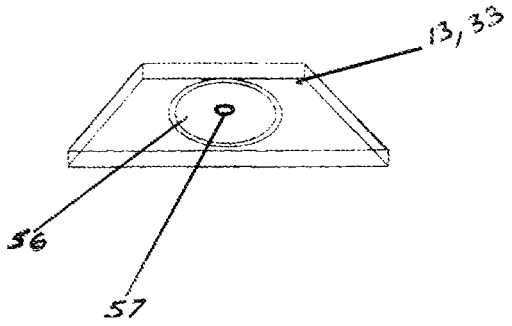
FIG. 9 is a perspective view of the inner surface of a trapezoidally shaped support plate without ridges for a device according to the present invention.
Figure 10:
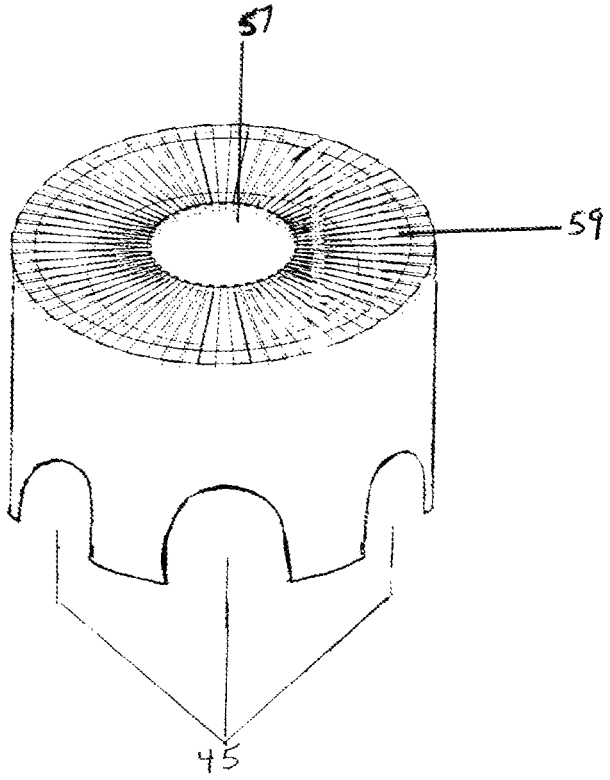
FIG. 10 is a perspective view of a cylindrically shaped fastener holding member for a device according to the present invention.

The base of the fastener holding member 15 and/or 35 includes matching ridges and sits within this circular indentation well 56. However, in certain embodiments the ridges are omitted entirely from the pair of support plate 13 and fastener holding member 15 and/or from the pair of support plate 33 and fastener holding member 35, e.g., as illustrated in FIG. 9. In one particular embodiment, fastener holding member 35, e.g., as shown in FIG. 10, and the inner surface of its corresponding support plate 33, e.g., as shown in FIGS. 7 and 8, are provided with such ridges, allowing fastener holding member 35 to rotate in fixed increments and then lock into place (as described in greater detail below), while fastener holding member 15 and the inner surface of its corresponding support plate 13 are smooth. In certain embodiments, angular designations (such as 45, 90, 135 and/or 180) are etched around the circumference of the circular indentation well 56 (e.g., as shown in FIGS. 7 and 8) to represent degrees of angle placement of the fastener holding member 15 and/or 35, as applicable.

As noted above, a mini level 43 preferably is attached to the outer surface of at least one of the support plates 13 and 33 (support plate 33 in the present specific embodiment) by means of a plastic or metal holder 44 that, e.g., allows the level 43 to snap in or out when desired. In a preferred embodiment, there is an aperture 57 at the center of the circular indentation having a diameter of approximately 0.180 inches for the placement of the attachment member 37 to connect the support plate 13 or 33 to the jaw-engaging members 12 or 32, respectively, and to the fastener holding member 15 or 35, respectively, as illustrated in FIGS. 7 and 8.

It is noted that the fastener holding members 15 and 35 may have any of a variety of different shapes. In the illustrated embodiment, they are cylindrically shaped, which currently is believed to be optimal. Depending upon the particular embodiment, the bottom of either or both of fastener holding members 15 and 35 can be attached to or integral with the inner surface of the corresponding support plate 13 or 33, respectively. Alternatively, either or both of fastener holding members 15 and 35 may rotate freely on the inner surface of the corresponding support plate 13 or 33, respectively. Still further, e.g., using the structures such as described above, either or both of fastener holding members 15 and 35 may rotate only when disengaged from the inner surface of the corresponding support plate 13 or 33, e.g., by pulling it away against the force of a spring 42, and then lock into position upon release, as spring 42 draws the two members together and causes their corresponding ridges to mesh with each other.

One or more openings 45 are provided on the innermost portion of at least one of the fastener holding members 15 and 35 to accommodate the desired fastener. In the present embodiment, these openings 45 are provided as U-shaped or V-shaped notches or recesses, completely open on the innermost edge, each essentially a valley between two ridges with the ridges having a partially flattened top region. In the following embodiments, the openings 45 are configured as notches. However, any other types of openings instead may be used. In use, a fastener 2 is inserted into a pair of such notches 45, one on each side of the rotation axis 9, e.g., as shown in FIG. 1.

Figure 11:
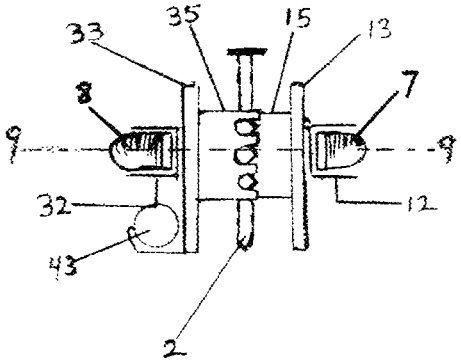
FIG. 11 is a side elevational view of a two-component device according to the present invention, with both components pressed together to hold a fastener.
Figure 12:
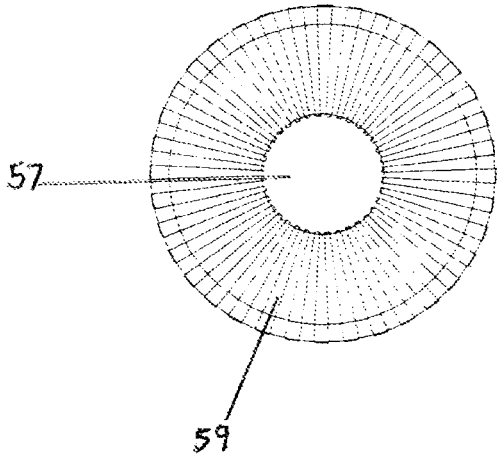
FIG. 12 is a top plan view of a representative ridge pattern for use in a device according to the present invention.
Figure 13:
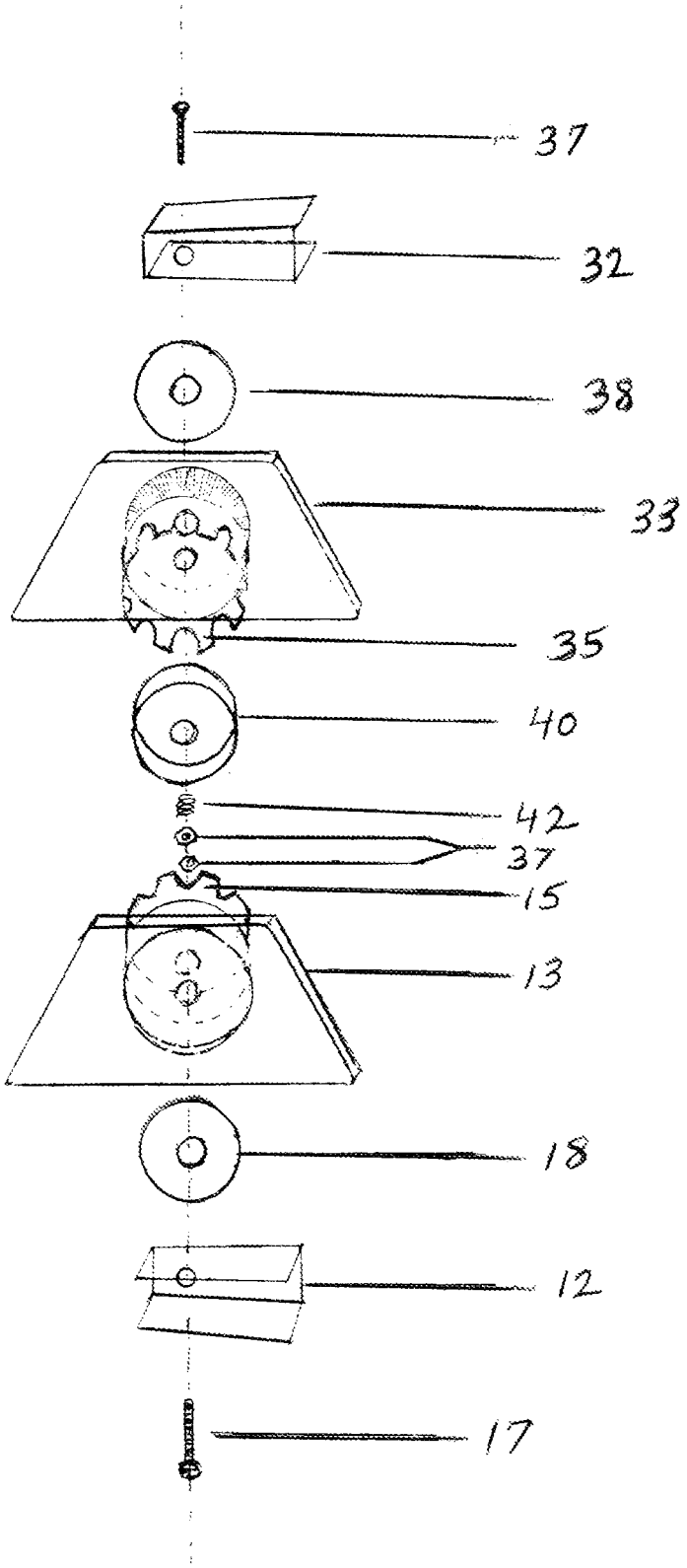
FIG. 13 is an exploded view of a two-component device according to the present invention.
Figure 14:
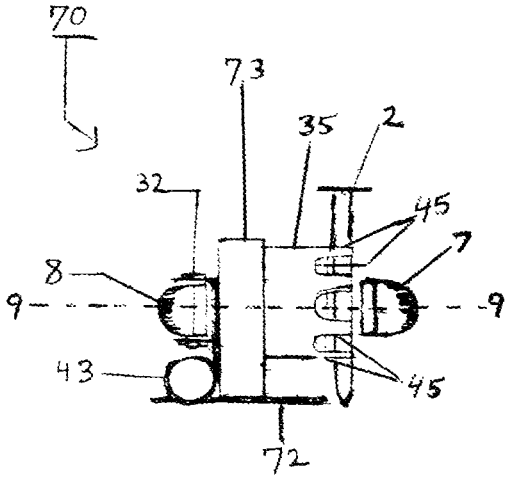
FIG. 14 is a side elevational view of a single-component fastener-holding device according to the present invention.
Figure 15:
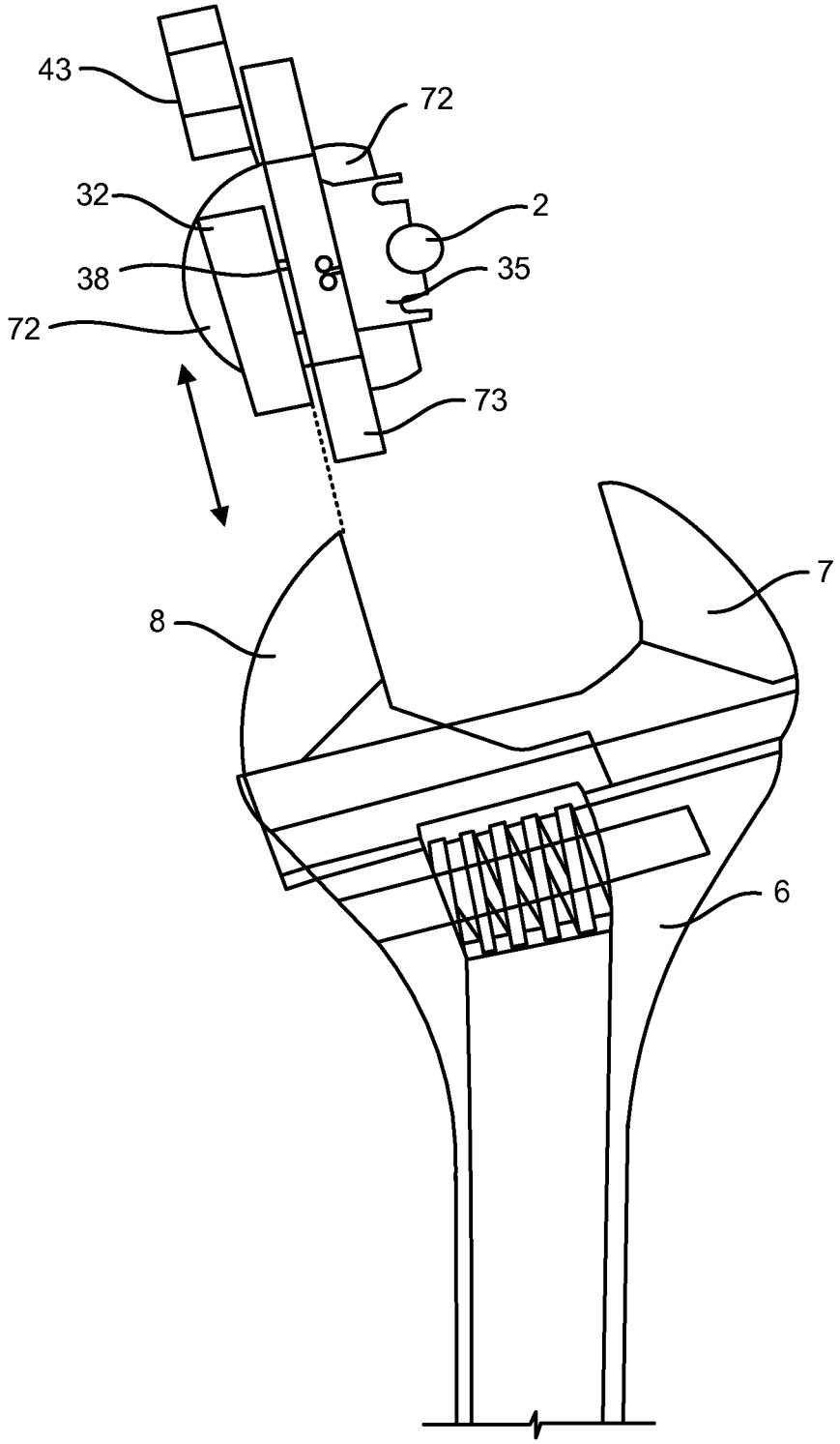
FIG. 15 is a first side elevational view showing the single-component device being installed onto the jaw of an existing tool.
Figure 16:
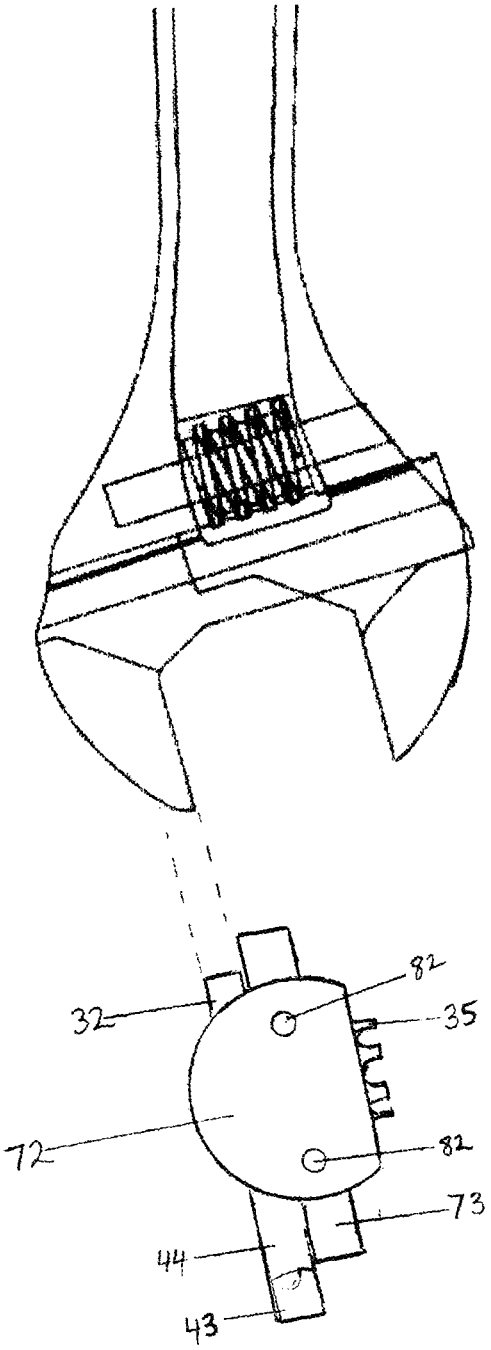
FIG. 16 is an opposite side elevational view showing the single-component device being installed onto the jaw of an existing tool.
Figure 17:
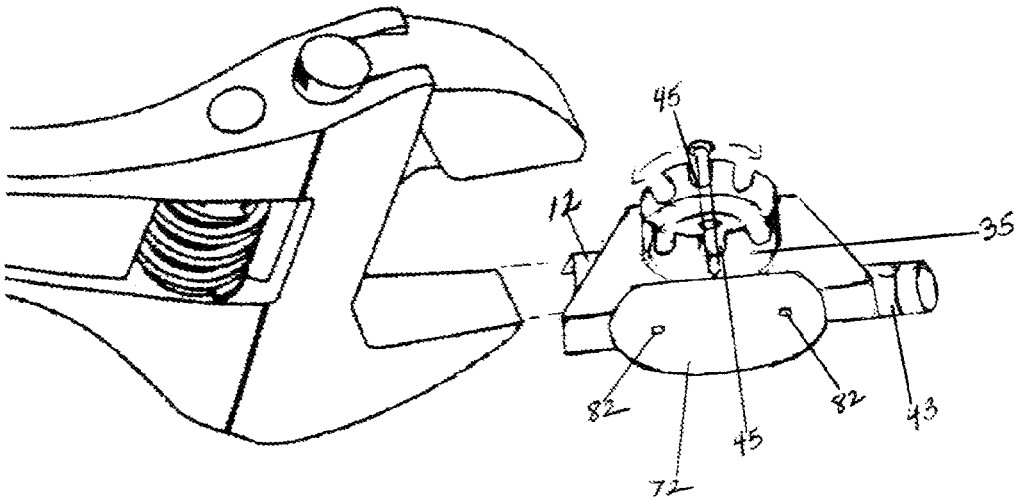
FIG. 17 is a first side perspective view showing the single-component device holding a fastener and being installed onto the jaw of an existing tool.
Figure 18:
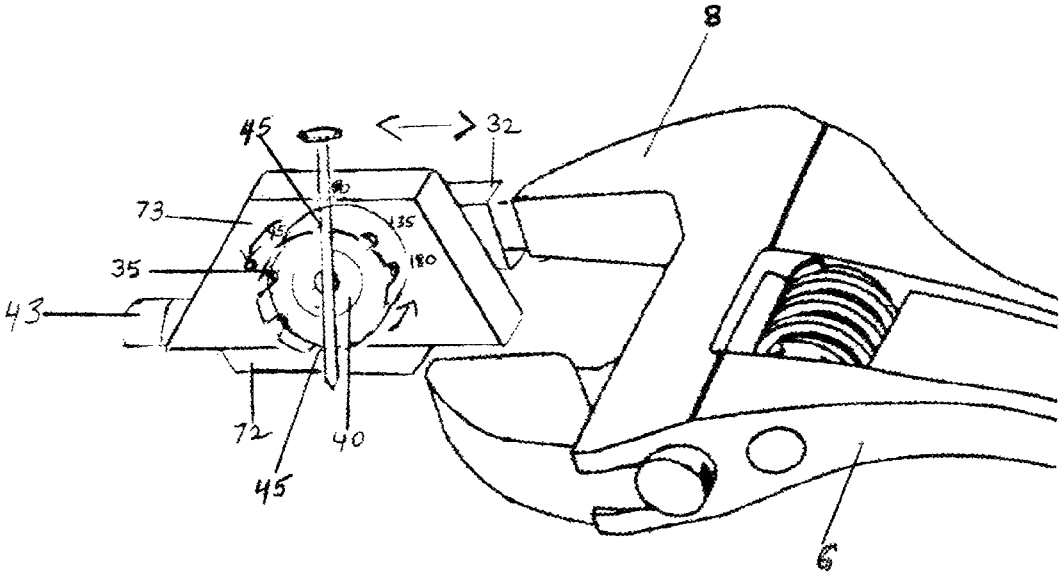
FIG. 18 is an opposite side perspective view showing the single-component device holding a fastener and being installed onto the jaw of an existing tool.

The inner surfaces of two fastener holding members 15 and 35 can be complementary in size and shape to each other, e.g., as shown in FIG. 1. In the specific embodiment shown, the fastener holding members 15 and 35 both have a cylindrical shape. The fastener holding member 35 has a well inside of the cylinder (i.e., the cylinder is fully or partially hollow) so that the fastener holding member 15 can slide within this well because of its smaller diameter, and the two pieces of the device fit together when in contact with each other as illustrated in FIG. 11. Preferably, the distances between each of the recesses on the fastener holding member 35 are substantially equal to the distances between the recesses on the fastener holding member 15, so that when a fastener 2 is sandwiched between fastener holding members 15 and 35, with the tool's jaws 7 and 8 set an appropriate distance apart, the recesses on the fastener holding members 15 and 35 form apertures having a continuous or closed perimeter, and preferably two of such apertures (formed by pairs of recesses on the opposite sides of fastener holding members 15 and 35) hold the fastener 2 in place. Because fastener holding member 15 can slide into fastener holding member 35, the sizes of these apertures can be enlarged or made smaller by moving the jaws 7 and 8 further apart or closer together, respectively, thereby providing appropriately sized apertures for a variety of different fasteners 2. Either or both of the fastener holding members 15 and 35 may be magnetic and/or have one or more than one magnetic parts to help secure the two pieces together and to hold the fastener 2 in place.

In the preferred embodiment, fastener holding member 35 has a well in the middle of the cylinder that may house a magnet 40 to hold the shaft of the fastener 2. It also houses spring 42 that provides tension between the fastener holding member 35 and its respective support plate 33. Spring 42 allows the fastener holding member 35 to be manually or mechanically disengaged from the support plate 33, with spring tension to snap it back to its original position on the support plate 33 when released. When disengaged, the spring 42 and attachment member 37 allows the fastener holding member 35 to be rotated 360° to the desired angle for placement of the fastener 2. When engaged, matching surface patterns, such as ridge pattern 59 shown in FIG. 12, on the bottom of fastener holding member 35 and the inner surface of support plate 33 cause those two members to be locked into position relative to each other.

In a preferred embodiment, as shown in FIG. 10, there is an aperture 57 at the center of the base of the of the fastener holding members 15 and 35 having a diameter of approximately 0.180 inch for the placement of the attachment members 17 and 37, respectively, to connect the fastener holding members 15 and 35 to their respective support plates 13 and 33.

Preferably, the height of the fastener holding member 15 is approximately 0.310 inch, the height of the fastener holding member 35 is 0.450 to 0.500 inch, its outer diameter is approximately 0.710 inches, and the distance between the recesses is 0.16 inch. In a preferred embodiment, the fastener holding member 15 has an outer diameter of 0.625 inch, and the fastener holding member 35 has an inner diameter of 0.630 inch, so that member 15 can fit inside member 35, and the recesses are located between the inner and outer circumference. In any event, all of the dimensions of each component 10 and 30 preferably are less than 1-3 inches and, more preferably, less than 2.25 inches.

To attach the device 5 to the wrench 6, the user places (e.g., slides) the jaw-engaging member 12 on the jaw 7 of the wrench 6 and places the jaw-engaging member 32 on the jaw 8. A nail 2 or other fastener can be placed between the components 10 and 30 before or after the such components 10 and 30 are installed on the jaws 7 and 8, respectively. However, at least for certain embodiments, doing so afterward often can make it easier to bring the two components 10 and 30 within an appropriate distance of each other at which the fastener 2 is held in place, but not so tightly as to interfere with it being driven into the wall or other surface.

To adjust the angle of the fastener 2, the cylindrical fastener holding member 35 is pulled about one millimeter inwardly, out of its position within the circular indentation well 56 on the support plate 33. The fastener holding member 35 is then rotated (clockwise or counterclockwise) to the desired angle and released, causing it to snap back down into the circular indention well 56 and locking it at the desired angle for nail/screw placement. Once the user tightens the two components 10 and 30 together by tightening the jaws 7 and 8 of the wrench 6 (or, e.g., for a pair of pliers, squeezing the pliers' handles), the fastener 2 is even further secured due to the force that the jaws of the wrench/pliers exert on the two pieces that are pressed together by the jaws. Once the fastener 2 is securely installed in the device 5, the bases 48 of the support plates 13 and 33 are seated against the desired surface (such as a wall, board or the like) so that the support plates 13 and 33 are perpendicular to the surface. Then, a hammer, screwdriver/gun, etc. is used to drive the fastener 2 into the surface.

In the preferred embodiments, the attachment members 37 that secure the support plates 13 and 33 to the jaw-engaging members 12 and 32, respectively, permit a loose enough connection so that the support plates 13 and 33 can rotate, pivot or swivel the overall device 5 to any desired angle in relation to the wrench 6 (or other tool). This swiveling feature is advantageous because the device can be swiveled without having to worry about the fastener 2 falling out, or having to assume an uncomfortable position when hammering, using a screwdriver or screw gun, etc.

One-Piece Tool-Adapter Devices.

Another set of embodiments according to the present invention provide a single-component device for holding a fastener 2, such as device 70, shown in FIGS. 14-22. Generally speaking, device 70 is identical to component 30 (described above) other than as noted below. Rather than relying on a separate components to close the notches 45, device 70 relies on the opposing jaw 7 (the one to which it is not attached) for that purpose.

The main difference between device 70 and component 30 is the inclusion within device 70 of a base plate 72 at the base of, and perpendicular to, support plate 73. Generally speaking, support plate 73 is identical to support plate 33 except that support plate 73 has a thickness of approximately 0.3 inches and includes on its base surface 78 an indented portion 79 that matches base plate 72 in size and shape so that base plate 72 is flush with the rest of base surface 78. Essentially, support plate 72 provides additional surface area for contacting the wall or other substrate into which the fastener 2 is to be driven, compensating for the absence of component 10.

Figure 19:
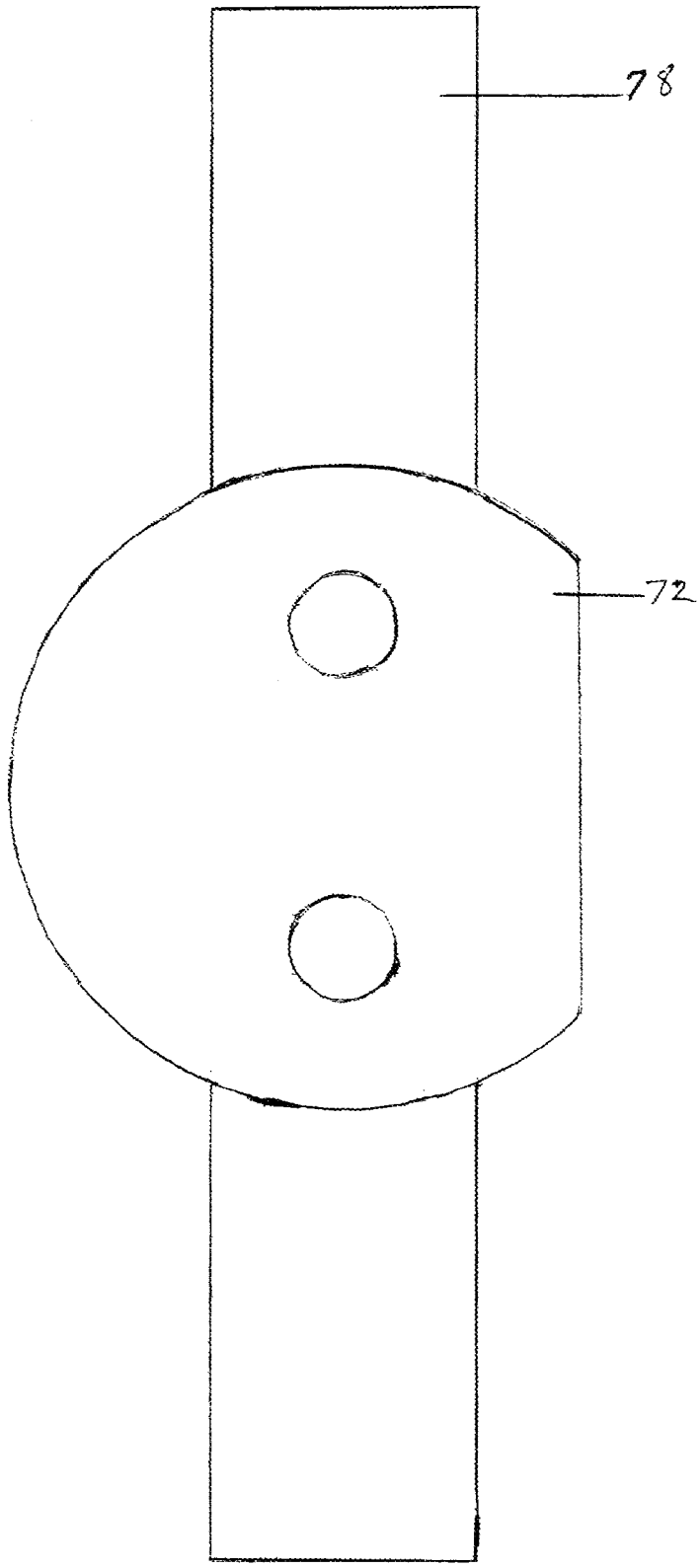
FIG. 19 is a bottom plan view showing the base of a support plate and an additional base plate.
Figure 20:
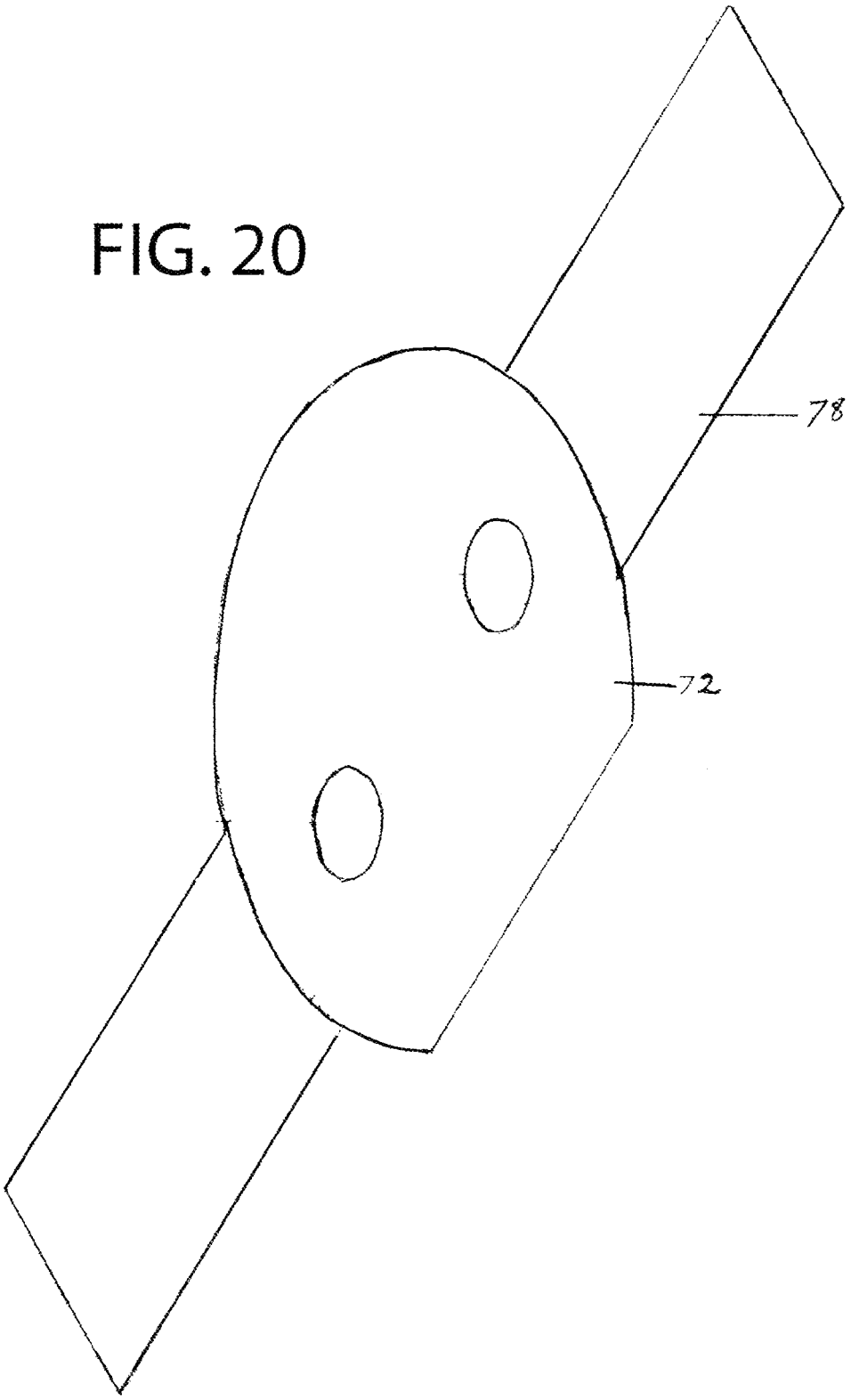
FIG. 20 is a perspective view showing the base of a support plate and an additional base plate.
Figure 21:
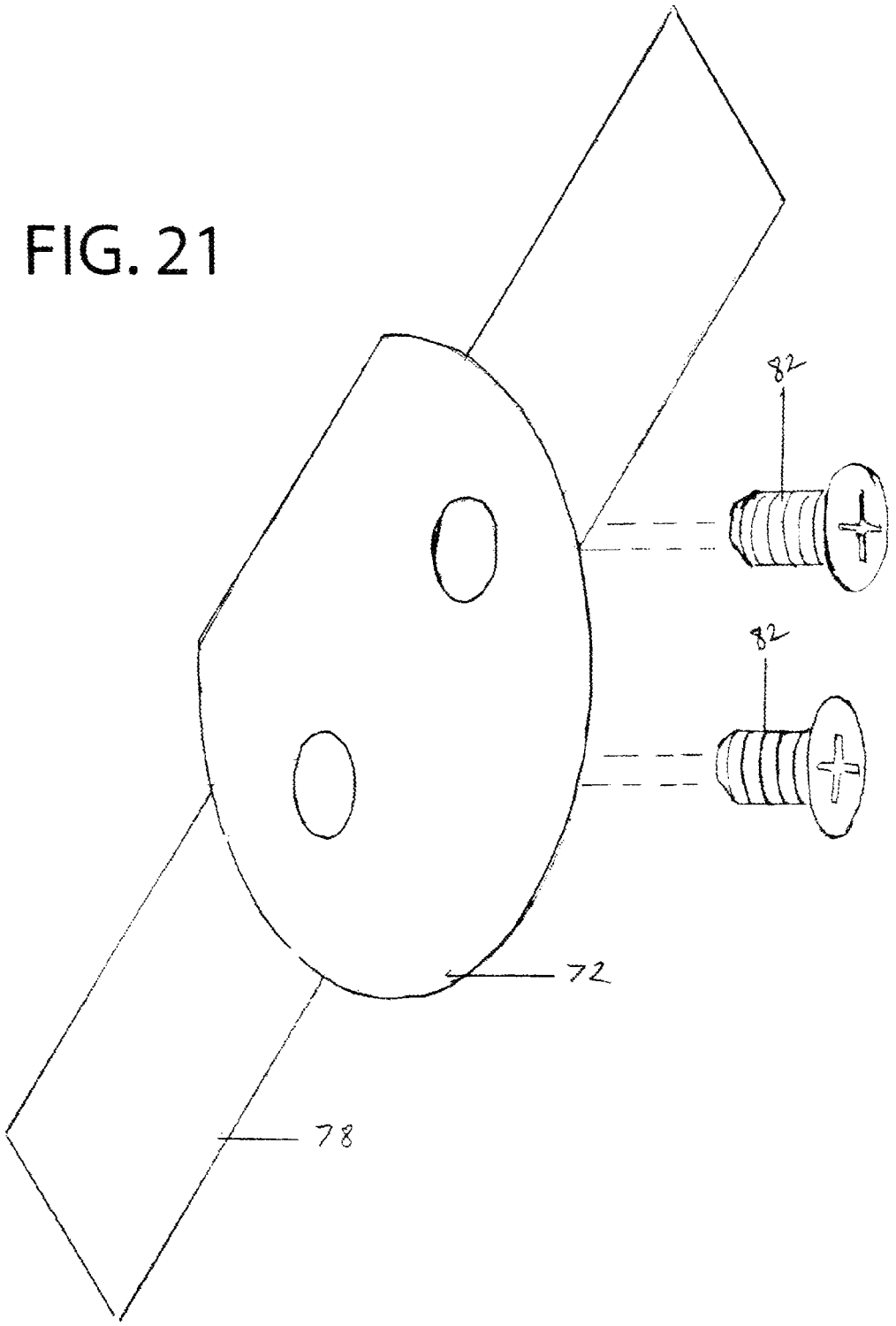
FIG. 21 is a perspective view showing the base of a support plate and an additional base plate being attached to it.
Figure 22:
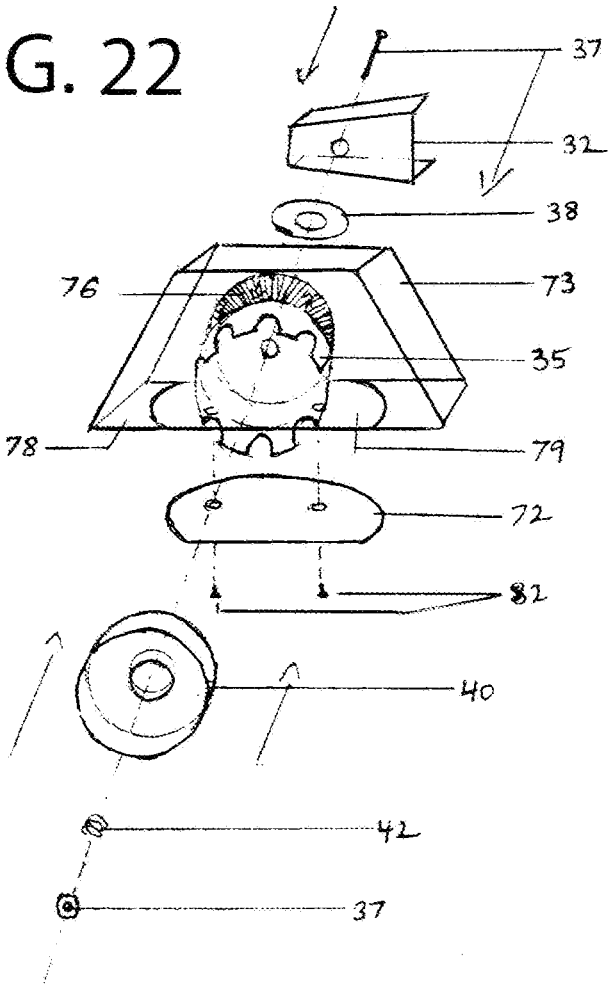
FIG. 22 is an exploded view of a single-component device according to the present invention.

As shown, base plate 72 preferably is flat and semicircular in shape. Base plate 72 ordinarily will be made of plastic or metal and, particularly if made of metal, may have separate padding attached to its outer surface, i.e., the surface that comes into contact with the wall or other substrate when in use, in order to avoid scratching or otherwise damaging such substrate. The semicircular shape currently is believed to provide maximum stabilization when placed against a wall, board or other surface. Preferably, it has a diameter of 1.25 inches and is 0.050 inch thick. However, it instead can be of a variety of shapes and sizes. It may be integral with support plate 73, e.g., as shown in FIGS. 19 and 20, or it may be a separate piece attached to support plate 73, e.g., with the use of screws 82, as shown in FIG. 21. In either event, because it is fixedly attached to support plate 73, it also will pivot relative to attachment member 37.

In the preferred embodiments, the support plate 73 is approximately 0.3 inch thick, and the depth of the circular indentation well 76 within it extends approximately from 0.070 inch to 0.188 inch. Also, as with the above embodiments, any of the individual members may be integrated with each other to form a single unitary member.

Standalone Embodiments

Figure 23:
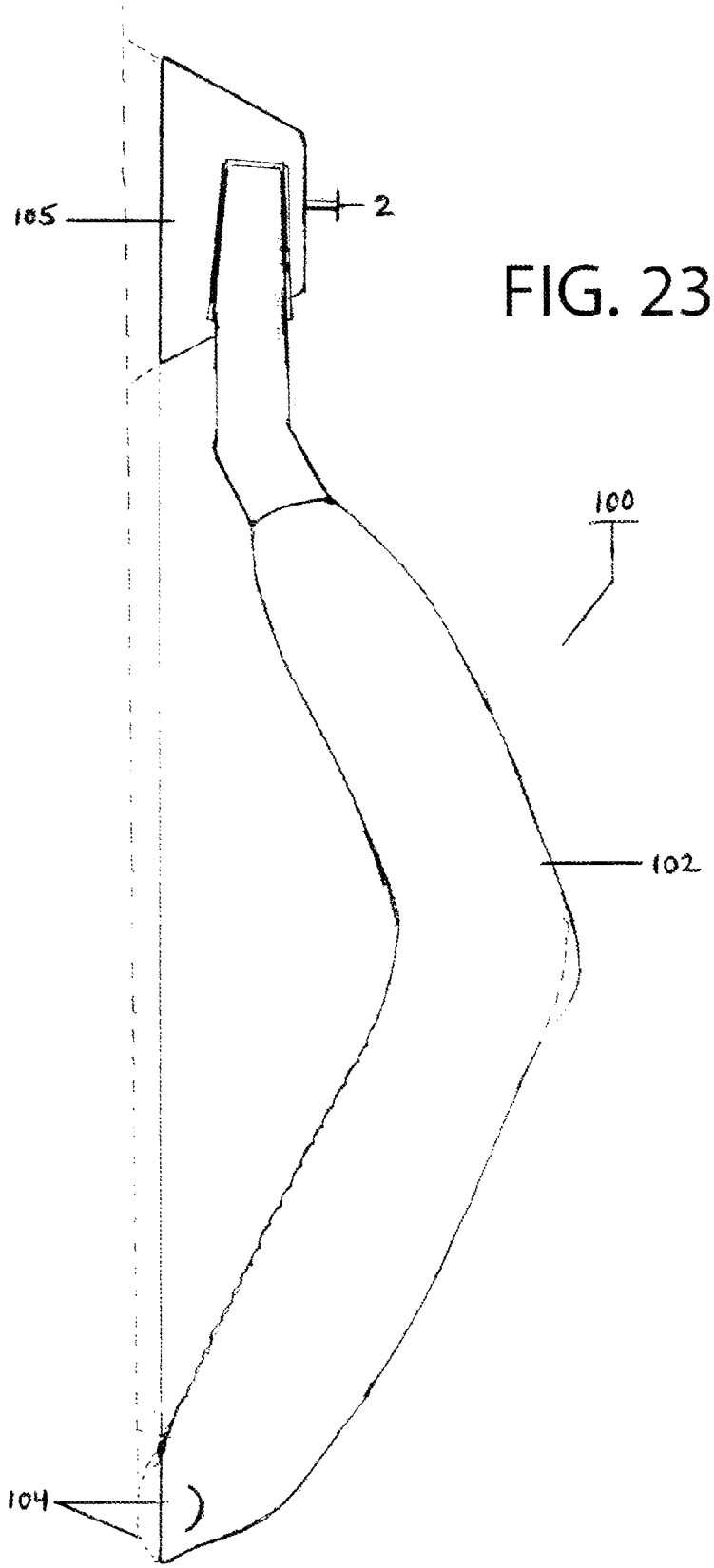
FIG. 23 is a side elevational view of a tool having an ergonomic handle, according to the present invention.
Figure 24:
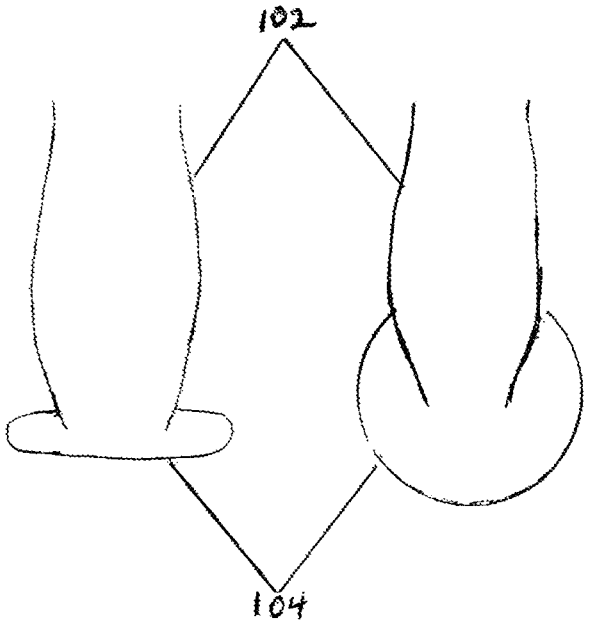
FIG. 24 shows a top perspective view (left) and a top plan view (right) of the base end of a tool handle according to the present invention.

Any of the embodiments discussed above may be provided as a standalone tool, e.g., with the individual component(s) permanently attached to (or integral with) one or two jaws (e.g., which are movable relative to each other) and are part of a larger tool, which itself can have any of a variety of different configurations. For instance, the handle of any such standalone tool can have any of a variety of different standard and/or ergonomic shapes and styles, e.g., to maximize ease of use in different situations. Preferably, the dimensions of the handle are no less than four inches long and no longer than 12 inches, providing sufficient length and surface area to accommodate any size hand. In one such embodiment, e.g., as shown in FIG. 23, a tool 100 has a handle 102 that is curved or L-shaped with a base 104 at the opposite end of the fastener-holding device 105 that is wider than the handle 102 itself. The base 104 of the handle 102 may be any of a variety of shapes, such as flat and circular (e.g., as shown in FIG. 24) or shaped as an elongated cylindrical extension perpendicular to the handle 102. More generally, the surface of base 104 may be flat or have a radius (i.e., curved in one or both dimensions perpendicular to the wall or other substrate). As illustrated in FIGS. 23 and 24, the flat design allows the fastener holder device 105 and the base 104 of the handle 102 to contact the substrate (e.g., wall, floor, board) simultaneously, providing greater stability with the least stress on the user's arm/hands. Similar benefits can be achieved with a curved base 104, and the curvature also can permit the base 104 to roll against the substrate (side-to-side and/or front-to-rear).

One example of a standalone device or tool 200 in accordance with the present invention is shown in FIGS. 25-43. As will be apparent from the following discussion, tool 200 preferably can be configured in a variety of different ways, e.g., depending upon the needs of the user. Generally speaking, tool 200 can incorporate all of the features described above in connection with the other embodiments and, because it is provided as a standalone tool that can be designed from scratch, can be configured with additional features as well.

Figure 25:
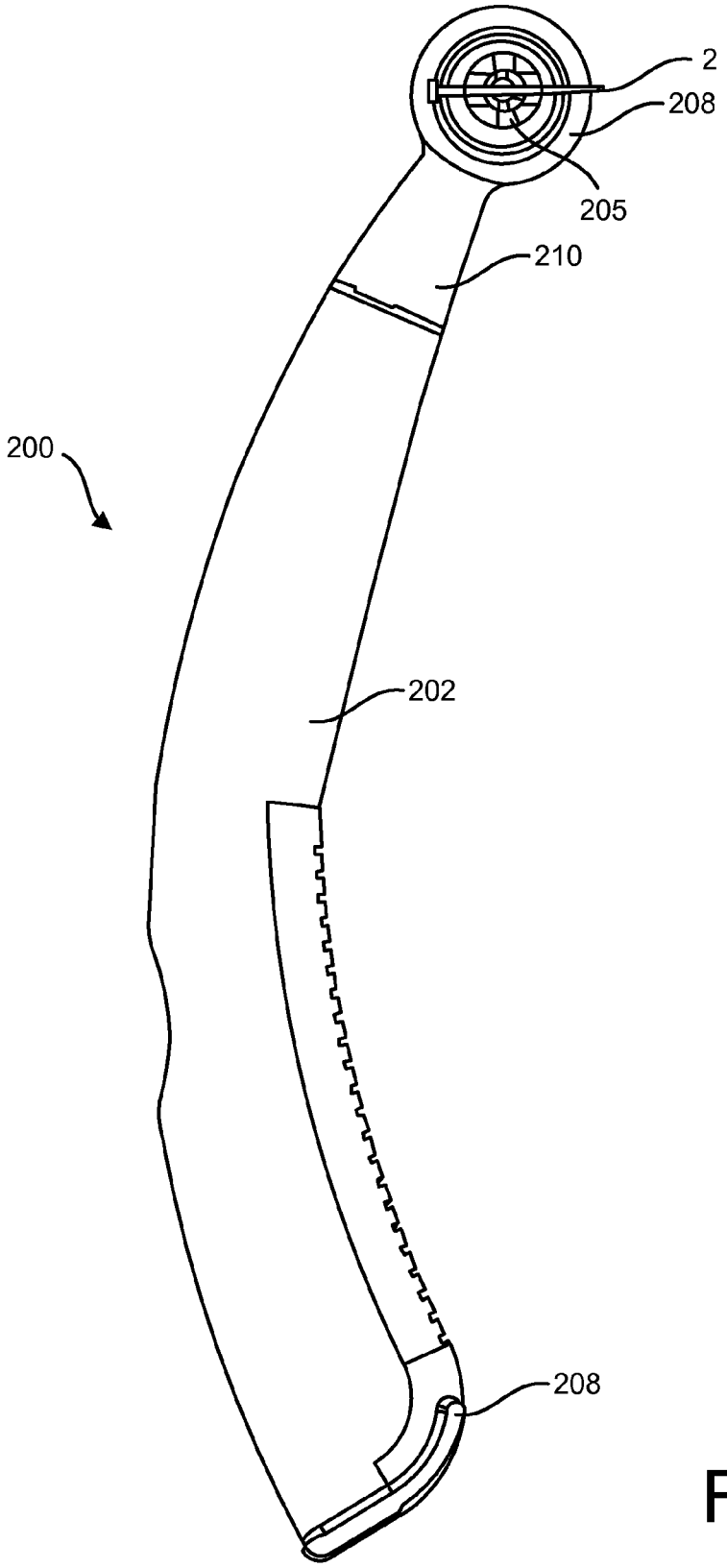
FIG. 25 is a right side elevational view of a standalone tool according to the present invention, with a fastener inserted.
Figure 26:
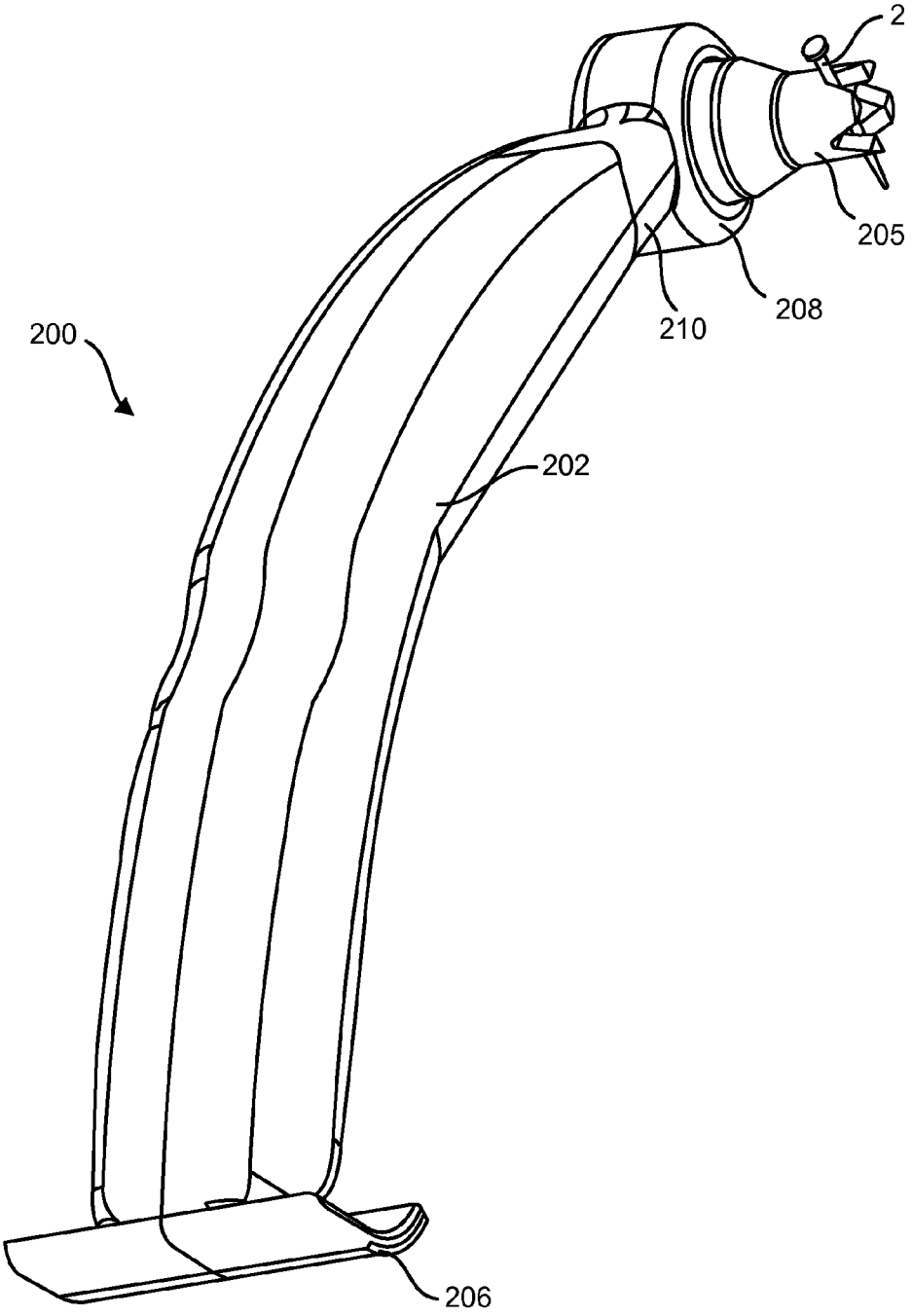
FIG. 26 is a bottom right perspective view of a standalone tool having a separate rear stabilizer, with a fastener inserted.
Figure 27:
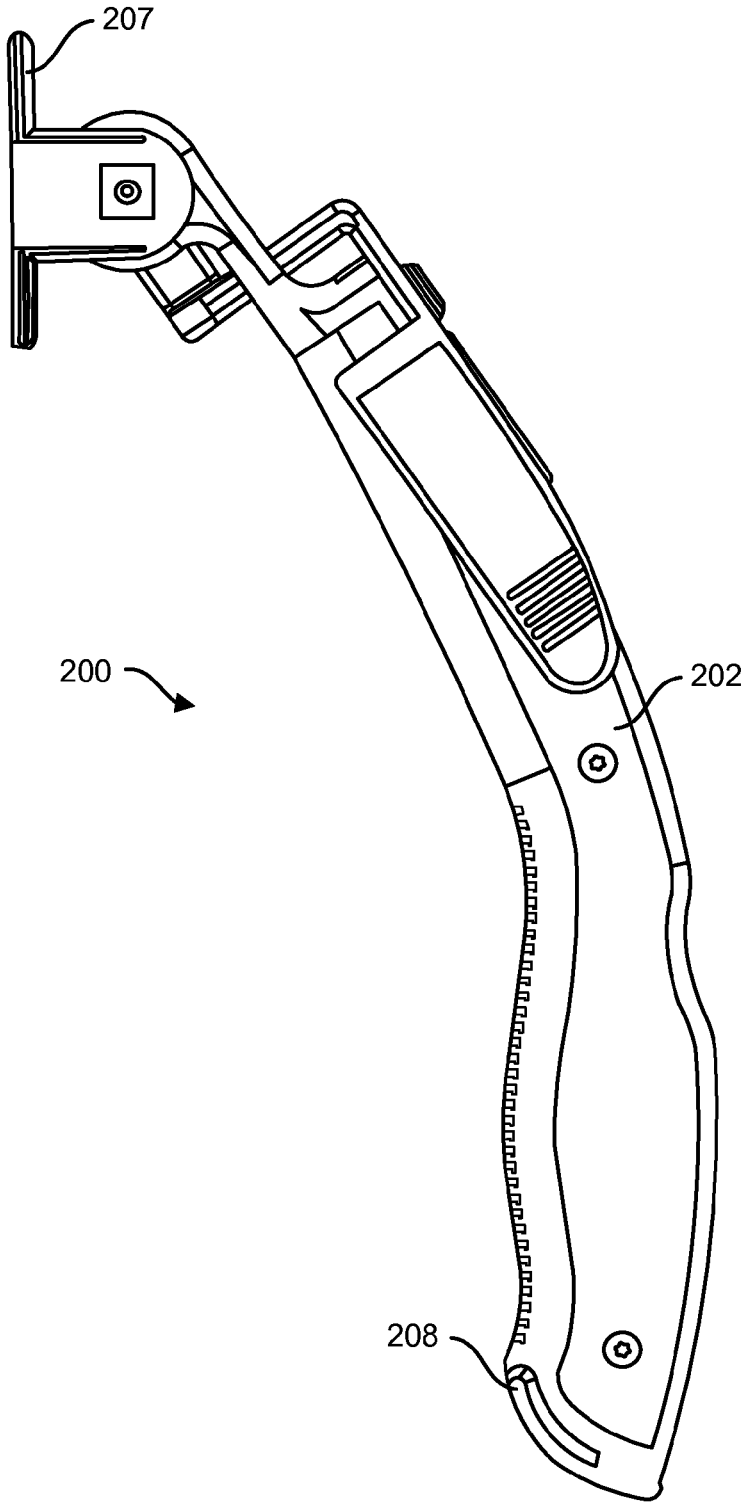
FIG. 27 is a left side elevational view of a standalone tool having a front stabilizer.
Figure 28A:
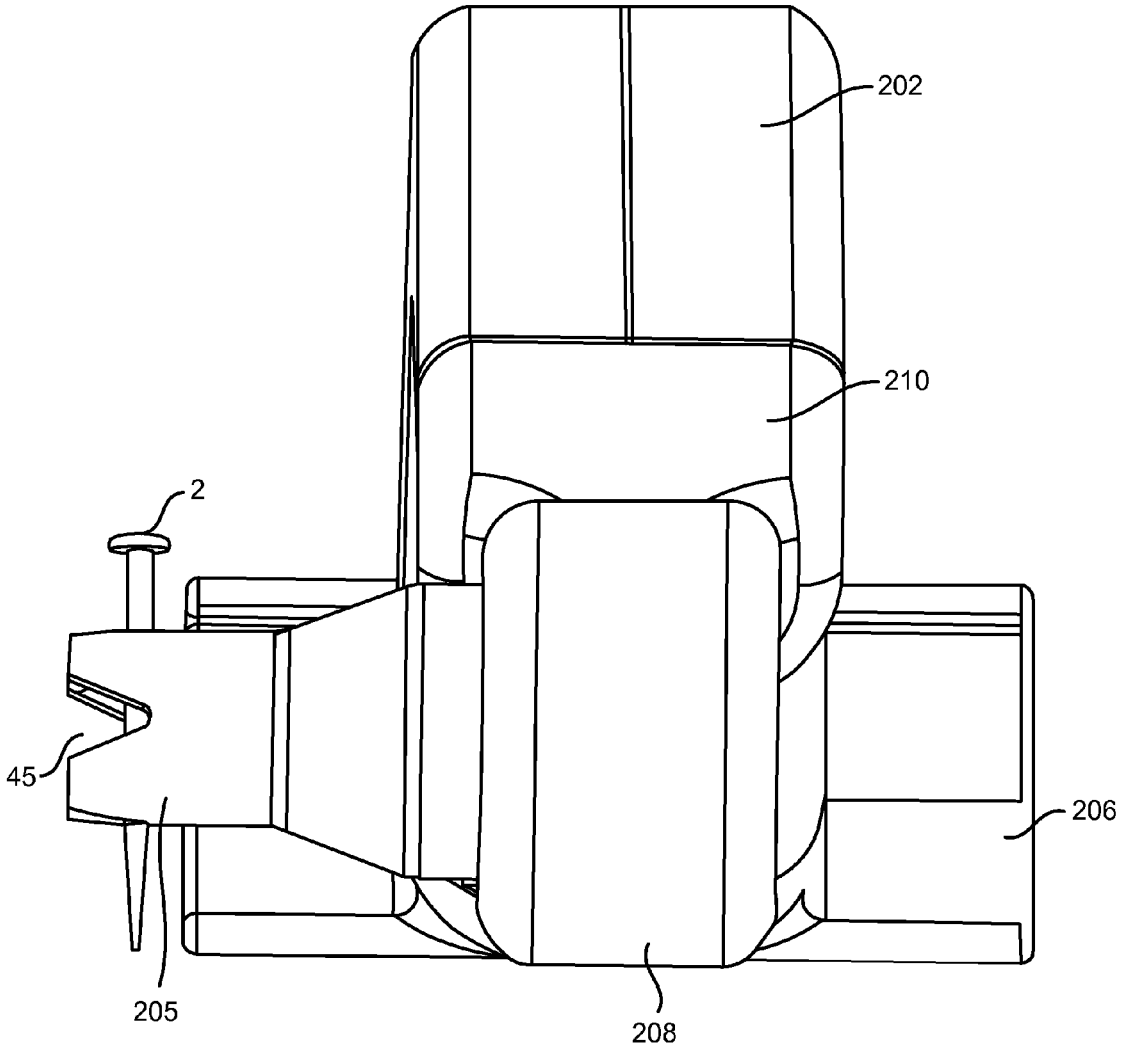
FIG. 28A is a top plan view of the front portion of a standalone tool without a separate front stabilizer and with a fastener inserted.
Figure 28B:
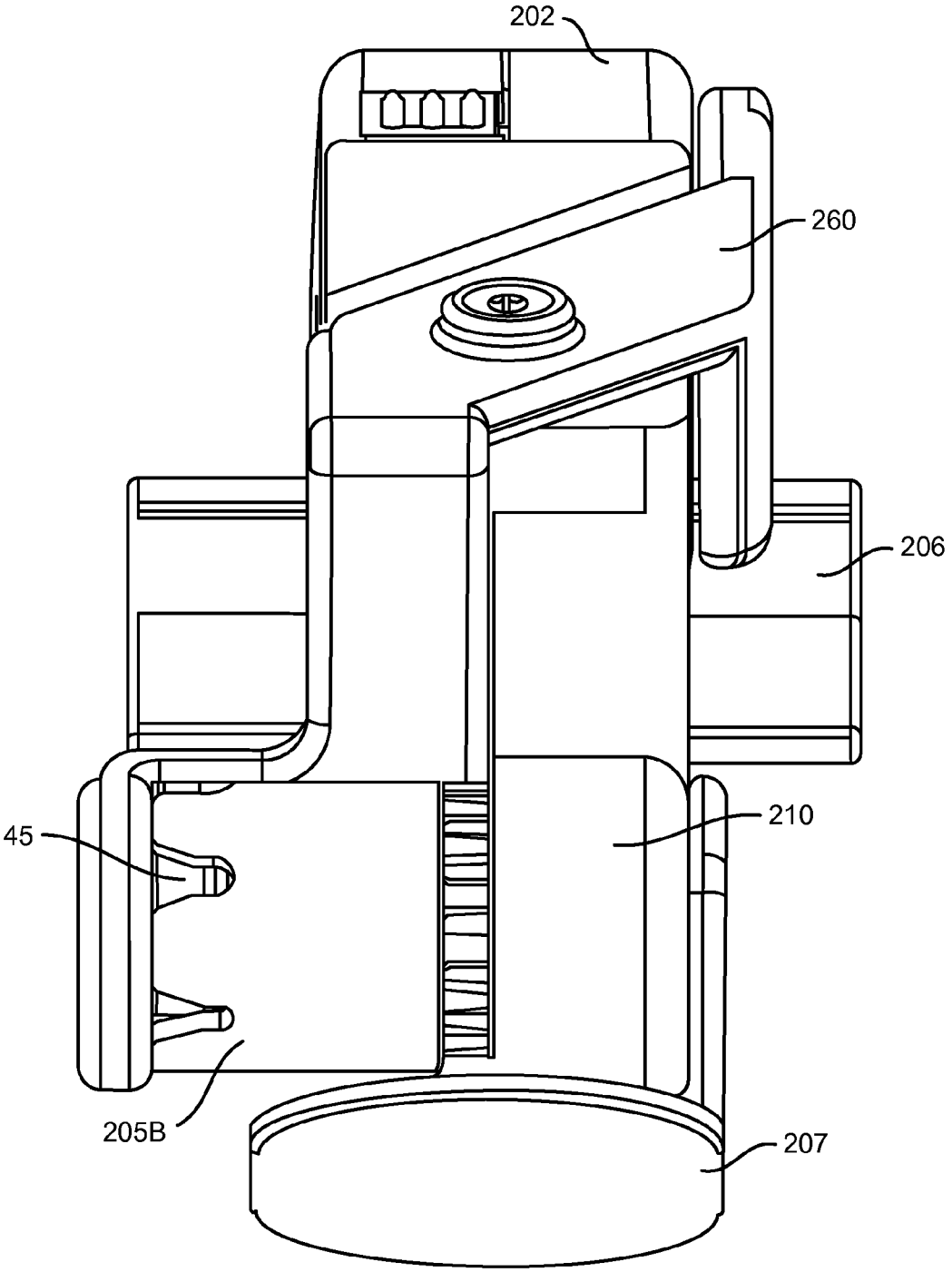
FIG. 28B is a top plan view of the front portion of a standalone tool having a separate front stabilizer.
Figure 29:
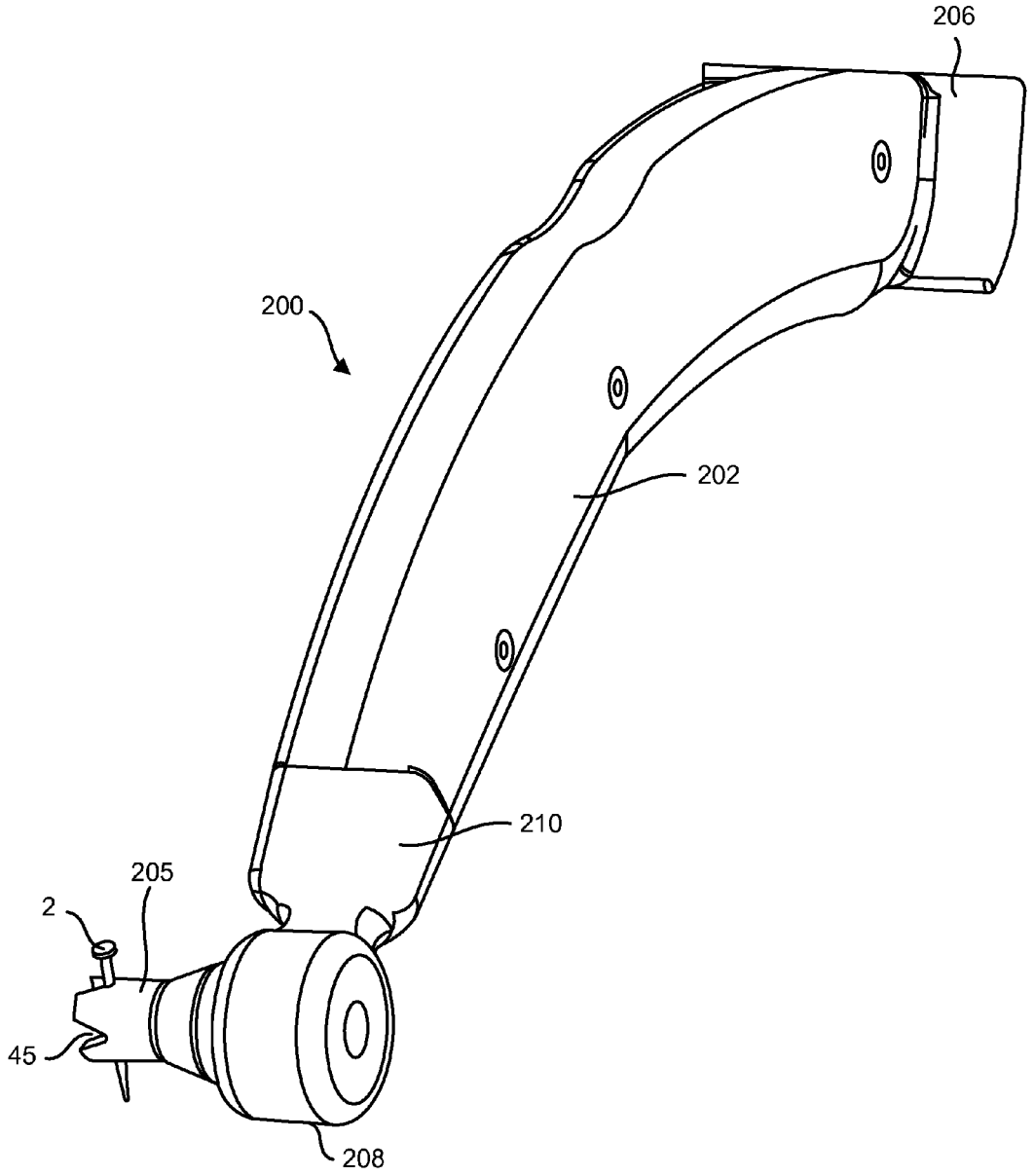
FIG. 29 is a top left perspective view of a standalone tool having a separate rear stabilizer, with a fastener inserted.
Figure 30:
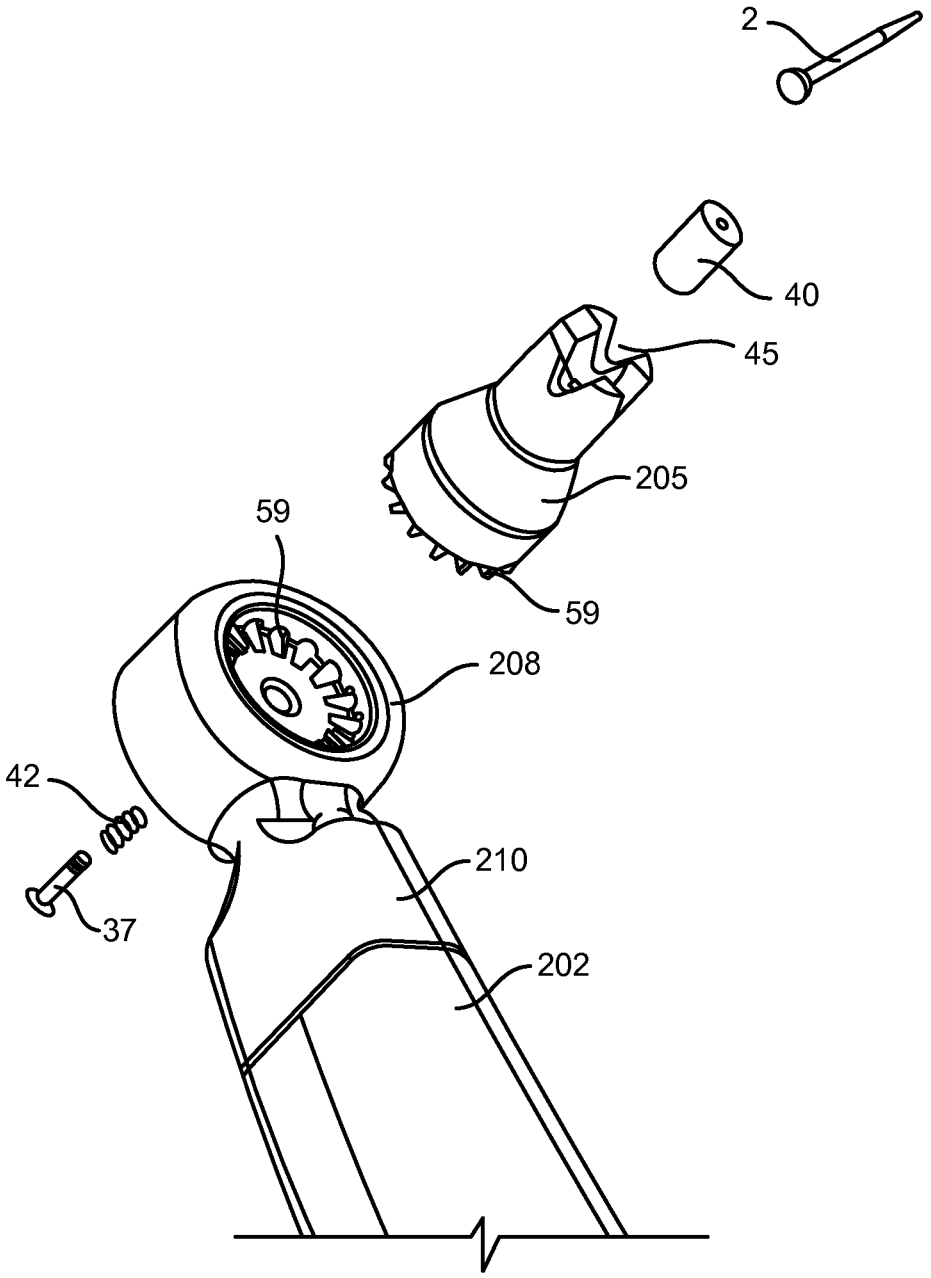
FIG. 30 is a perspective view of the front portion of a standalone tool with its fastener holding member assembly and inserted fastener shown exploded to better illustrate the individual components.
Figure 31:
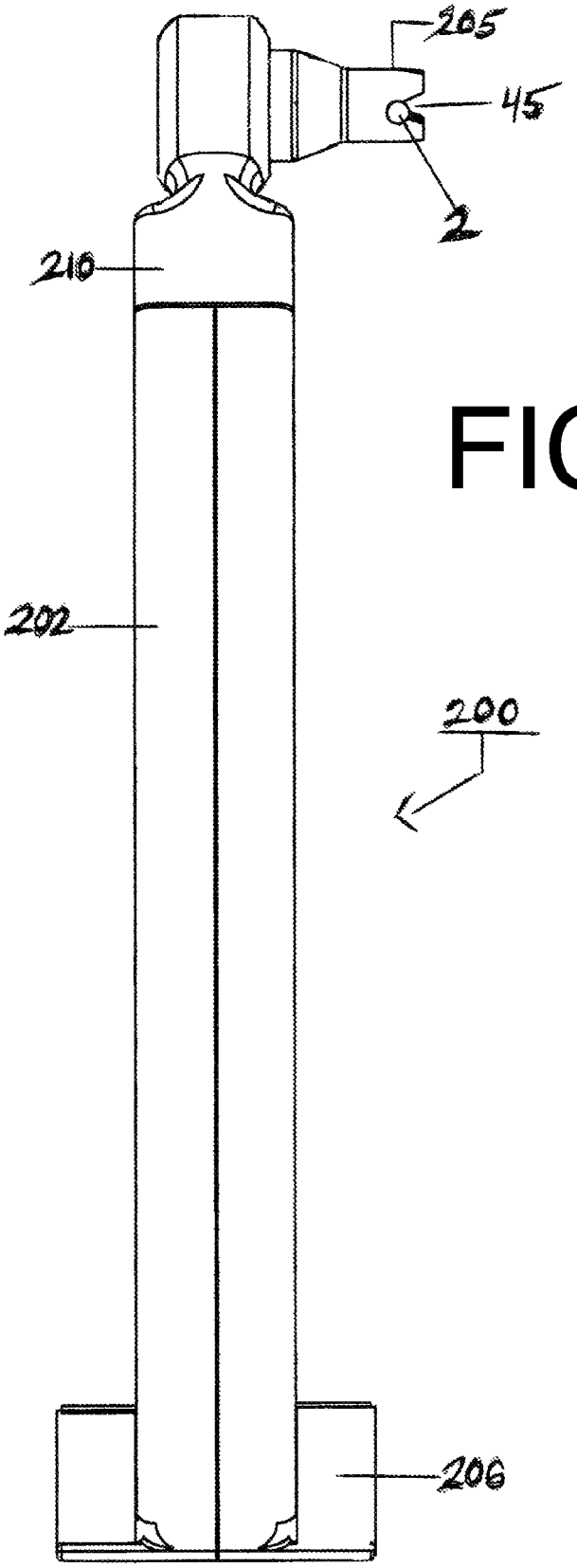
FIG. 31 is a top plan view of a standalone tool having a separate rear stabilizer, with a fastener inserted.
Figure 32:
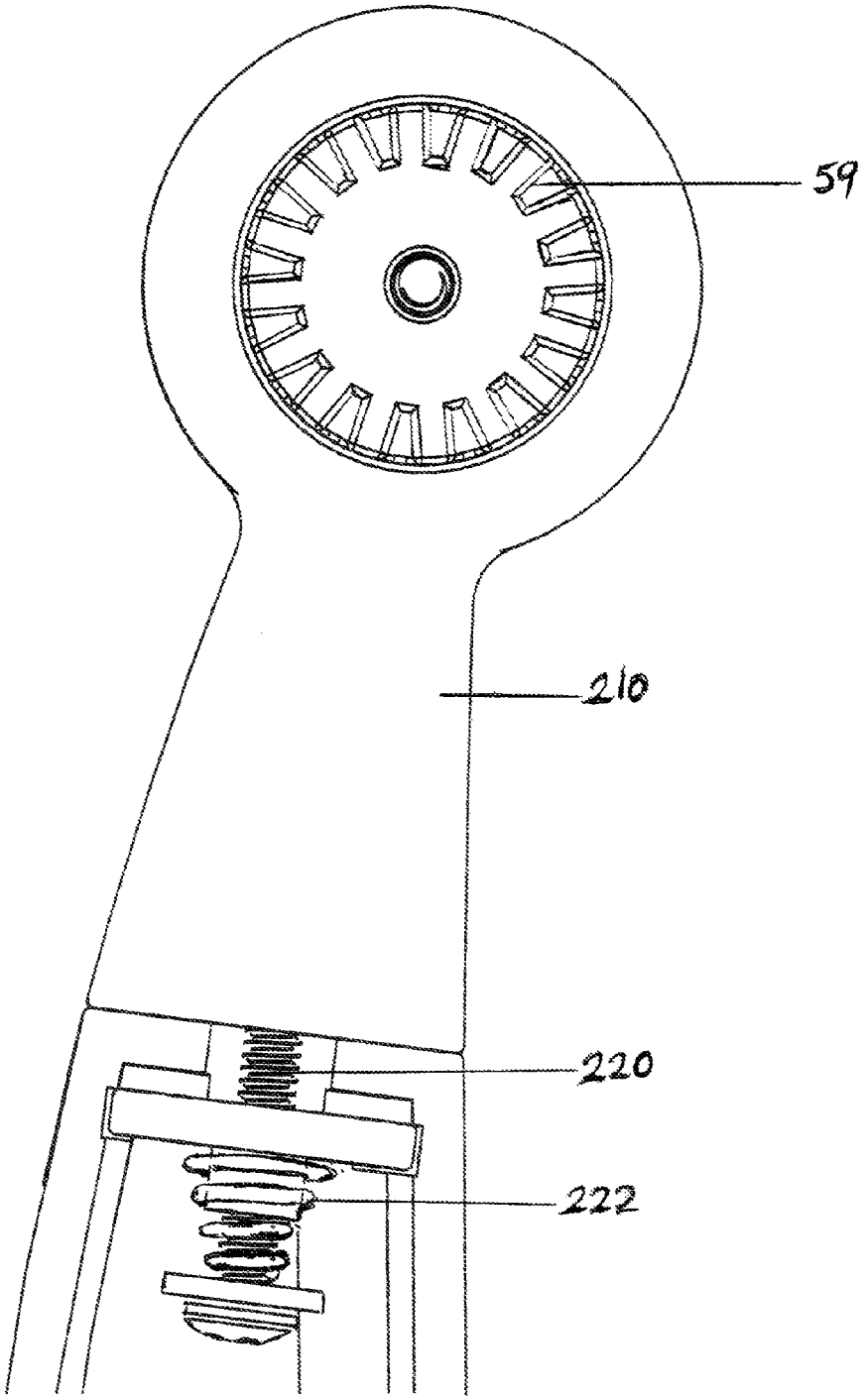
FIG. 32 is a right side elevational view of the front portion of a standalone tool with its fastener holding member assembly removed, and with the portion immediately behind the head portion shown in cutaway to illustrate the mechanism for attaching the head portion.
Figure 33:
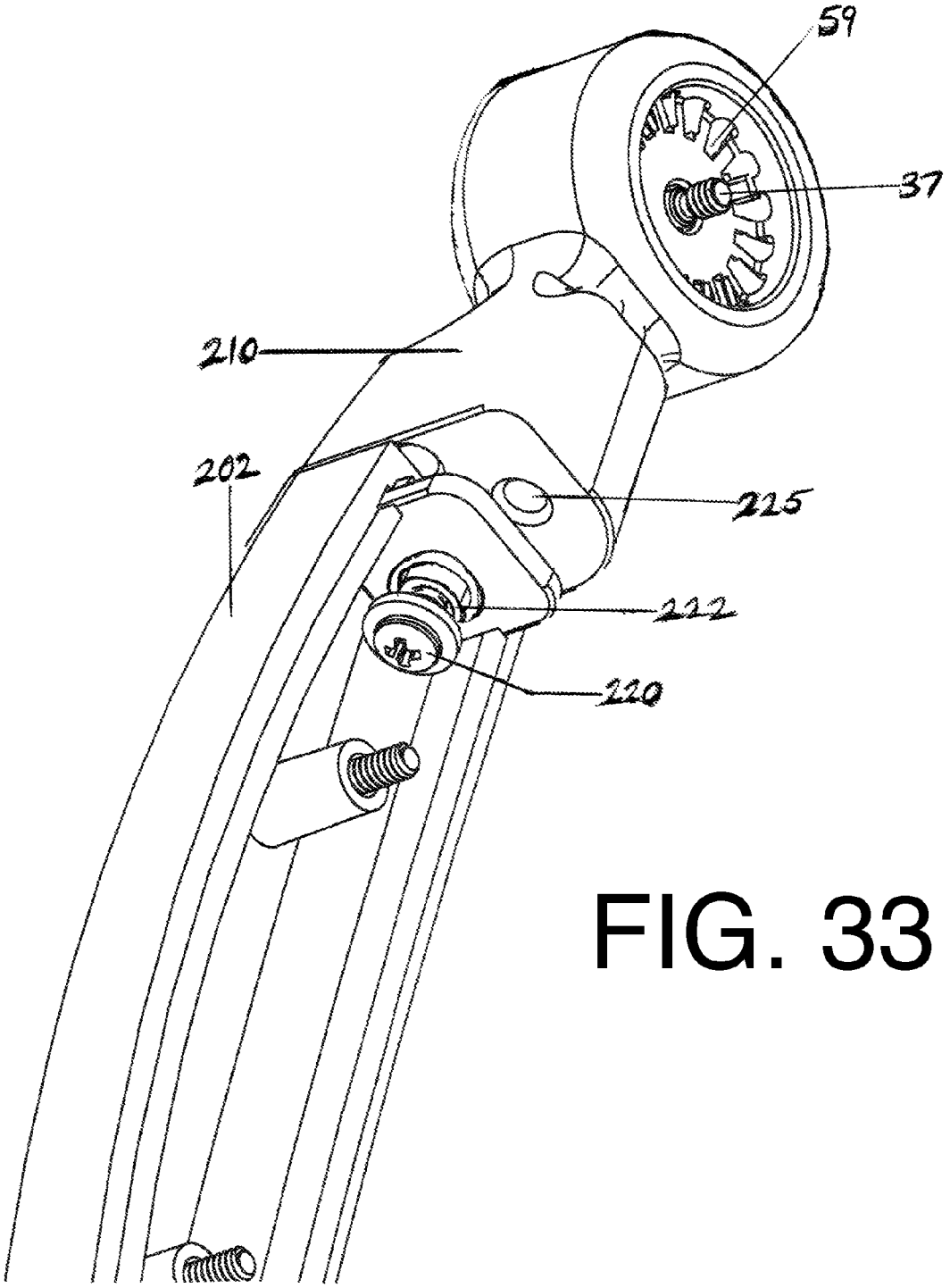
FIG. 33 is a top right side perspective view of the front portion of a standalone tool with its fastener holding member assembly removed, and with the portion immediately behind the head portion shown in cutaway to illustrate the mechanism for attaching the head portion and to illustrate part of the rear surface of the head portion.
Figure 34:
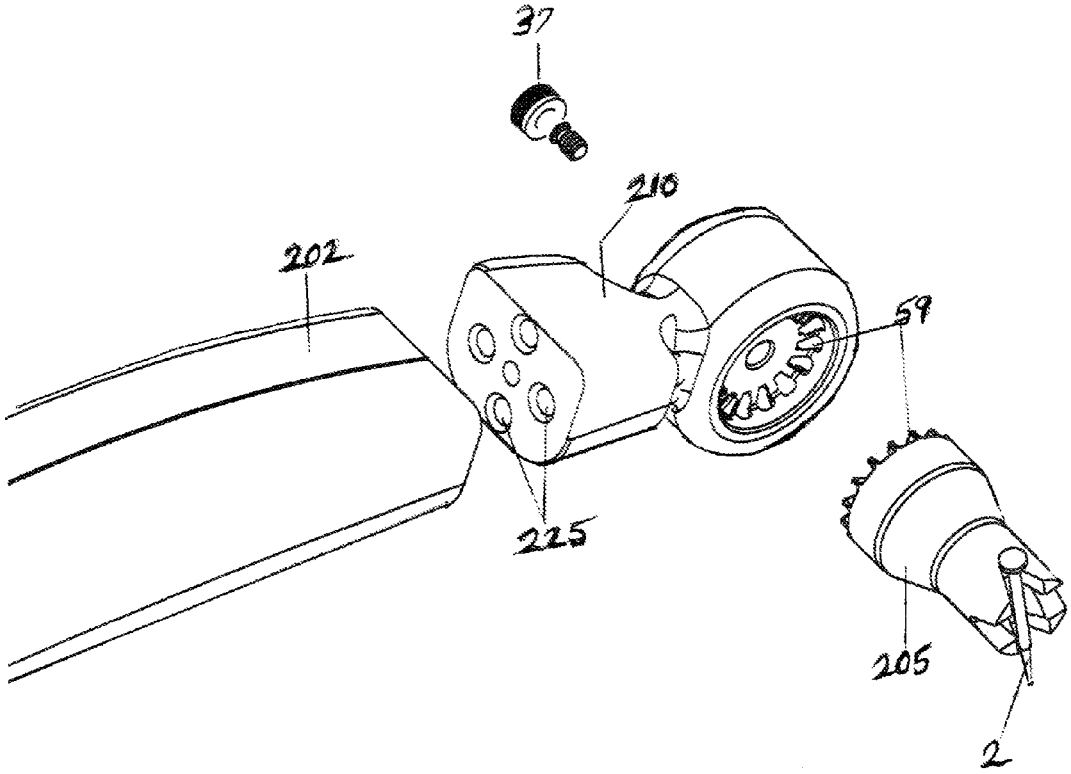
FIG. 34 is a top right side perspective view of the front portion of a standalone tool with its fastener holding member assembly and its head portion exploded out.
Figure 35:
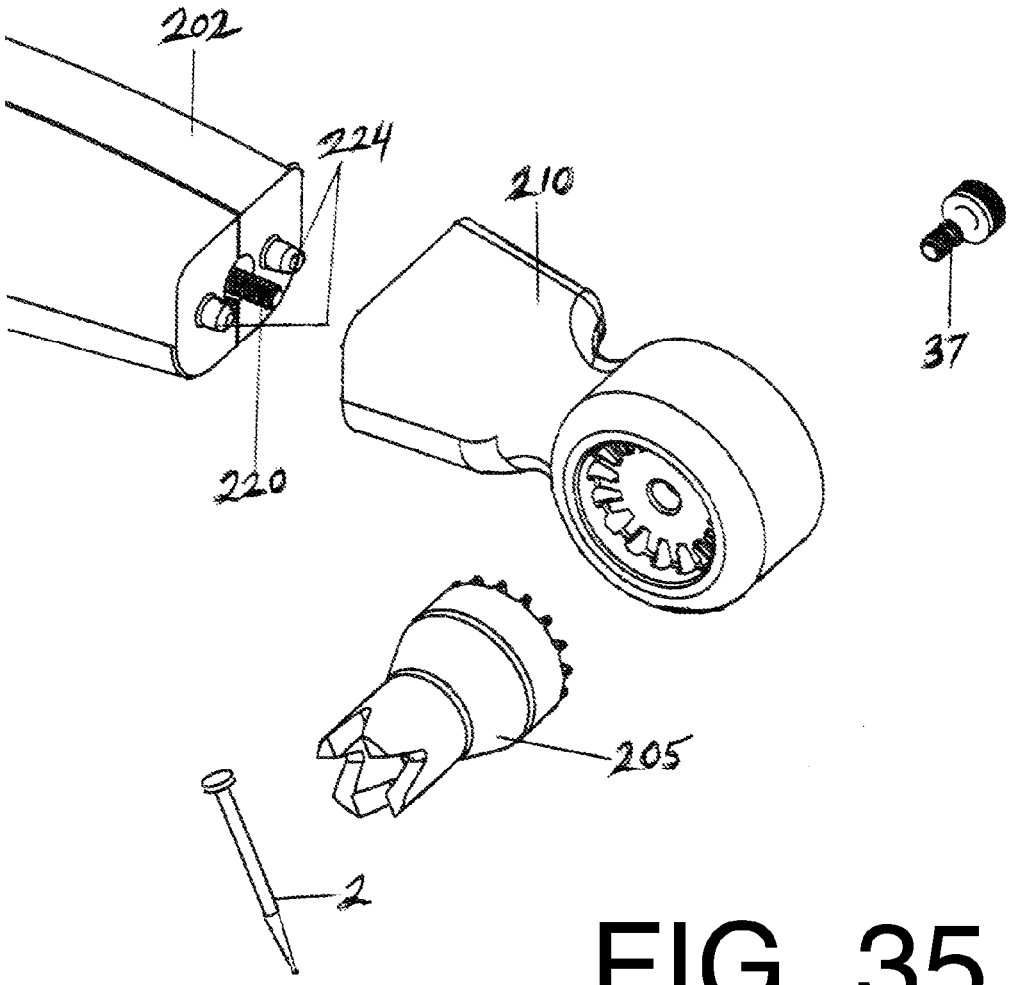
FIG. 35 is a top right perspective view of the front portion of a standalone tool with its fastener holding member assembly and its head portion exploded out.

In the current embodiment, tool 200 has a main body structure that includes a curved handle 202 (e.g., curved in a longitudinally oriented plane as shown in FIGS. 25 and 27), a head portion 210 (which, in the present embodiment, continues the same curvature) and, optionally, a separate stabilizer element 206 at its proximal (or rear) end and/or a separate stabilizer element 207 at its distal (or front) end. As also shown, in the current embodiment handle 202 and head portion 210 are tapered in width and in thickness, being larger at the proximal end and smaller at the distal end, which is believed to be more comfortable and ergonomic.

Where provided, proximal-end stabilizer 206 preferably is curved in the same plane as handle 202, and distal-end stabilizer 207 (or at least the portion that contacts the wall or other surface into which a fastener 2 is to be inserted) preferably is substantially flat and/or planar. Such stabilizers 206 and/or 207 can be placed against the exterior wall or other surface when tool 200 is in use, in order to stabilize it as the fastener 2 is being inserted (e.g., pounded or screwed)

into such surface. Depending upon the desired features, either or both of stabilizers 206 and 207 can be fixedly attached to the remainder of tool 200 (e.g., for greater stability) or can be pivotally attached (e.g., for better accommodating different kinds of surfaces). It is noted that in certain embodiments, either or both of proximal-end stabilizer 206 and/or distal-end stabilizer 207 are detachably attachable to the remainder of tool 200 (e.g., via screws, compression fit, etc.) in order to provide the user with different options (e.g., with regard to offset from the wall or other surface, amount of curvature desired at the points of contact and/or type of material making contact with such wall or other surface. For these purposes, different kinds of interchangeable stabilizers 206 and/or 207 may be available, e.g., with different kinds of curvature and/or different kinds of surface contact material (e.g., hard plastic or soft padding) and/or each end of bottom surface 208 may be configured according to similar options. In other embodiments, one or both of stabilizers 206 and 207 is integrally formed as part of a larger piece of tool 200.

Alternatively, if either or both of such stabilizers 206 and 207 are omitted, the bottom surface 208 of tool 200 instead can be placed against the exterior wall or other surface when the tool 200 is in use. Particularly in such a case, as shown in the drawings, any angular changes at the corresponding proximal and/or distal end(s) preferably are smoothly curved (e.g., rounded). Also in such a case, such contact areas preferably either are made of protective material (e.g., softer material, such as padding, natural or synthetic rubber, fabric or cloth material, and/or a softer plastic) or covered with such protective material. Such protective material preferably is provided at any point that could make contact with the wall or other surface into which the fastener 2 is to be inserted, in order to protect such surface from potential damage. Generally speaking, e.g., in order to ensure that all such contact areas are in fact covered with protective material under all possible use cases and/or to provide uniformity of appearance, it usually is preferable to provide such protective material across larger portions of the tool 200, such as the entire distal and/or proximal ends of the tool 200, the entire cylindrical portion of the head 210 that houses the fastener holding member, or even the entire tool 200.

Tool 200 also includes a fastener holding member 205 at its distal (or front) end. Generally speaking, fastener holding member 205 preferably is the same as the other fastener holding members discussed above and is attached to the remainder of tool 200 in the same manner, e.g., preferably: either being magnetic or including a separate magnetic component 40 to assist in holding the fastener 2; and being rotatable and spring-biased (e.g., using spring 42) so as to lock into any of a number of rotational positions (e.g., through the use of spring 42 and interlocking mating surfaces, such as radially oriented ridges 59), while also capable of being pulled away and then rotated (around axis 9) to another desired position. However, while the current embodiments use mating surfaces to provide for a fixed or discrete number of possible rotational orientations (which can provide for more secure positioning by allowing the fastener holding member 205 to lock into place), alternate embodiments use more uniform (but preferably friction-enhancing) surfaces so that fastener holding member 205 can be rotated to any desired position (thereby providing for finer selection of the desired angular orientation). Optionally, as discussed above in connection with certain other embodiments, fastener holding member 205 may be part of a larger assembly or component that is pivotally attached to the remainder of tool 200 (e.g., capable of pivoting in the same plane as the curvature of handle 202).

In the current embodiment, fastener holding member 205 includes only two pairs of notches 45, with each pair sized and shaped for a differently sized fastener 2. In one specific embodiment, one pair is for accommodating very small nails and the other is for accommodating medium to large-sized nails. By providing only two pairs of notches, the widths of the two fasteners 2 that are accommodated can collectively occupy up to almost 180° of the circumference of the fastener holding member, meaning that the diameter (or at least the functional portion of the diameter, i.e., the distal end that includes the notches 45) of fastener holding member 205 typically can be made smaller, thereby better accommodating shorter fasteners 2. For instance, in the current embodiment, the diameter of the distal end of fastener holding member 205 preferably is not more than 0.4 inch. In other embodiments, an even smaller diameter may be accommodated by providing just a single pair of notches 45, so that each such notch can occupy up to almost 180° of the circumference of the fastener holding member.

Another feature of tool 200 is that the entire head portion 210, to which fastener holding member 205 attaches, can itself be rotated to one or more different positions. In the embodiments shown in FIGS. 25-41, this feature is implemented using a similar structure as is used to allow fastener holding member 205 to be rotated to a number of fixed rotational orientations, e.g., using a screw 220 to loosely attach handle 202 to head portion 210 in combination with a spring 222 to provide a biasing force pulling such two components together. In the present case, however, a more limited number of rotational positional orientation options (typically, 2 or 4, and typically evenly spaced around a 360° range of rotation) ordinarily will be desirable. For instance, in FIGS. 25-41 the fastener holding member 205 is shown extending from the right side of the tool 200. However, it often will be desirable to rotate it so that it extends from the left side, e.g., for left-handed users. Still further, in some cases (e.g., where there is limited space) it will be desirable to rotate it so that it extends downwardly or upwardly, e.g., so that the side of the tool 200 instead can be pressed against the wall or other surface (for providing the desired stability), meaning that tool 200 will not extend out as far away from the wall (because the plane of curvature will be parallel to the plane of the wall).

A mechanism for permitting such rotation is best illustrated in FIGS. 32-35. As shown, head portion 210 is attached to the handle 202, with spring 222 biasing head portion 210 against handle 202. In addition, handle 202 includes a plurality of pegs (or other protrusions) 224 (two in the present embodiment), while head portion 210 includes a plurality of holes or openings 225 (four in the present embodiment) into which pegs 224 can be inserted. As a result of this configuration, a different rotational position is possible for each mating of the pegs 224 into the holes or openings 225 (four in the present embodiment, every 90°, so that the head portion 210 can be rotated so that it extends to the right, upwardly, to the left, or downwardly). To change rotational orientations, the user simply grasps the head portion 210, pulls it away from the handle 202 (thereby compressing spring 222), rotates it to the new position, and then allows spring 222 to pull the two components back together, with the pegs 224 extending into the new pair of holes or openings 225. In alternate embodiments, the openings 225 are provided in the handle 202 and the pegs 224 provided in the head portion 210, or any other mating or non-mating surfaces (e.g., friction-enhanced surfaces) are provided at the ends of such components.

Figure 36:
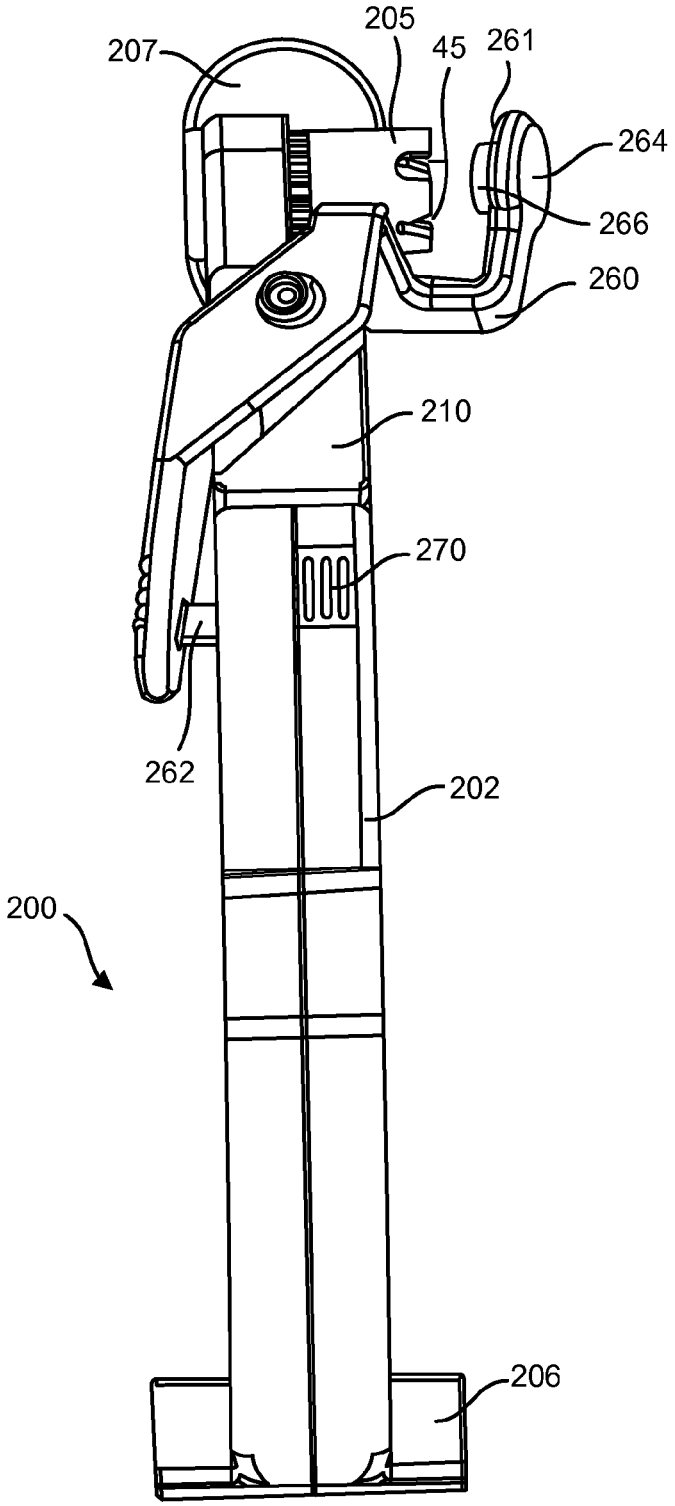
FIG. 36 is a top plan view of a standalone tool having separate front and rear stabilizers and a resilient crossover arm for covering the fastener holding member, with the two ends of the arm spread apart, e.g., in the configuration in which it would normally be when being attached to or detached from the tool.
Figure 37:
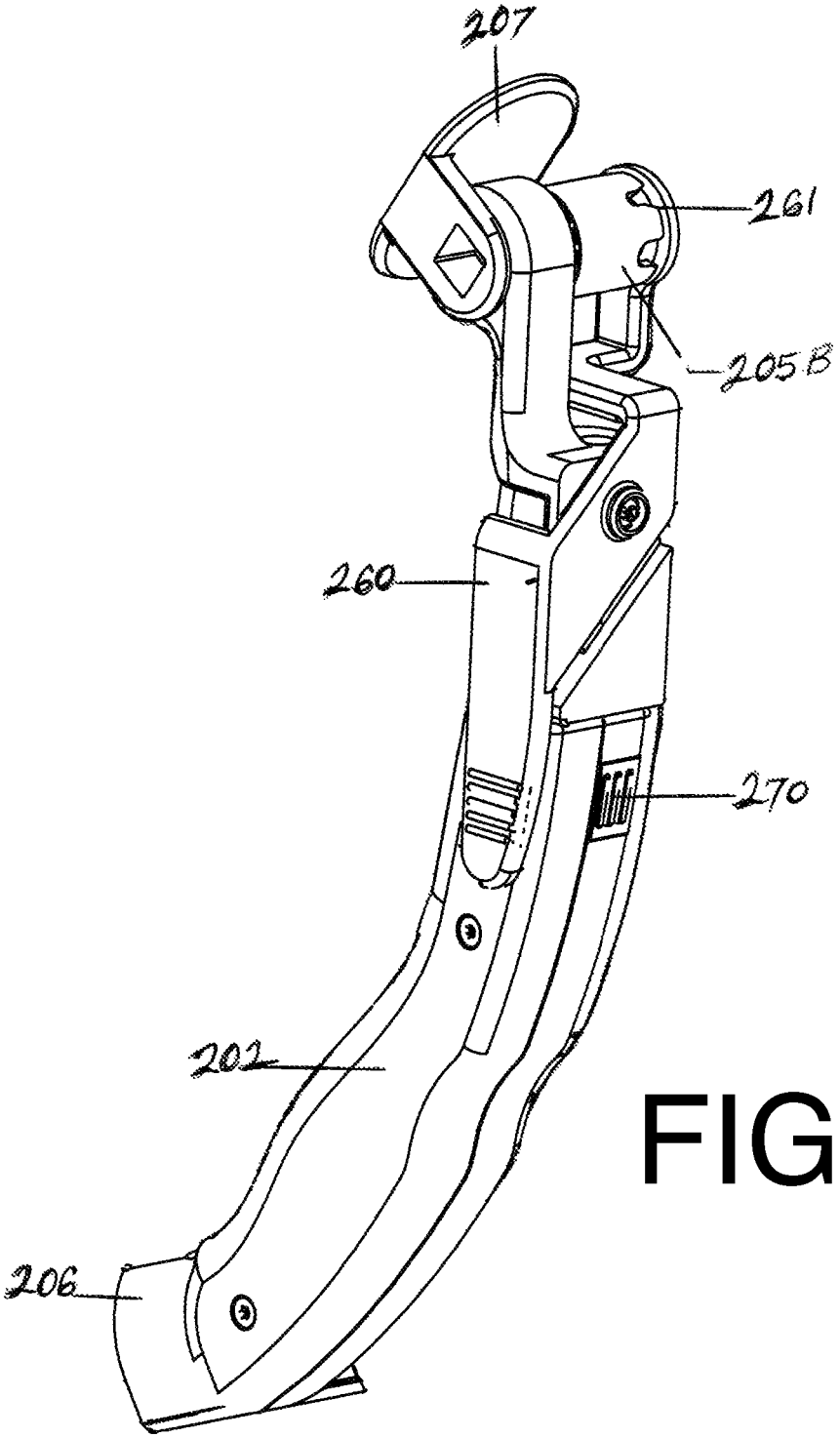
FIG. 37 is a top left perspective view of a standalone tool having separate front and rear stabilizers and a resilient crossover arm installed so as to cover the fastener holding member.
Figure 38:
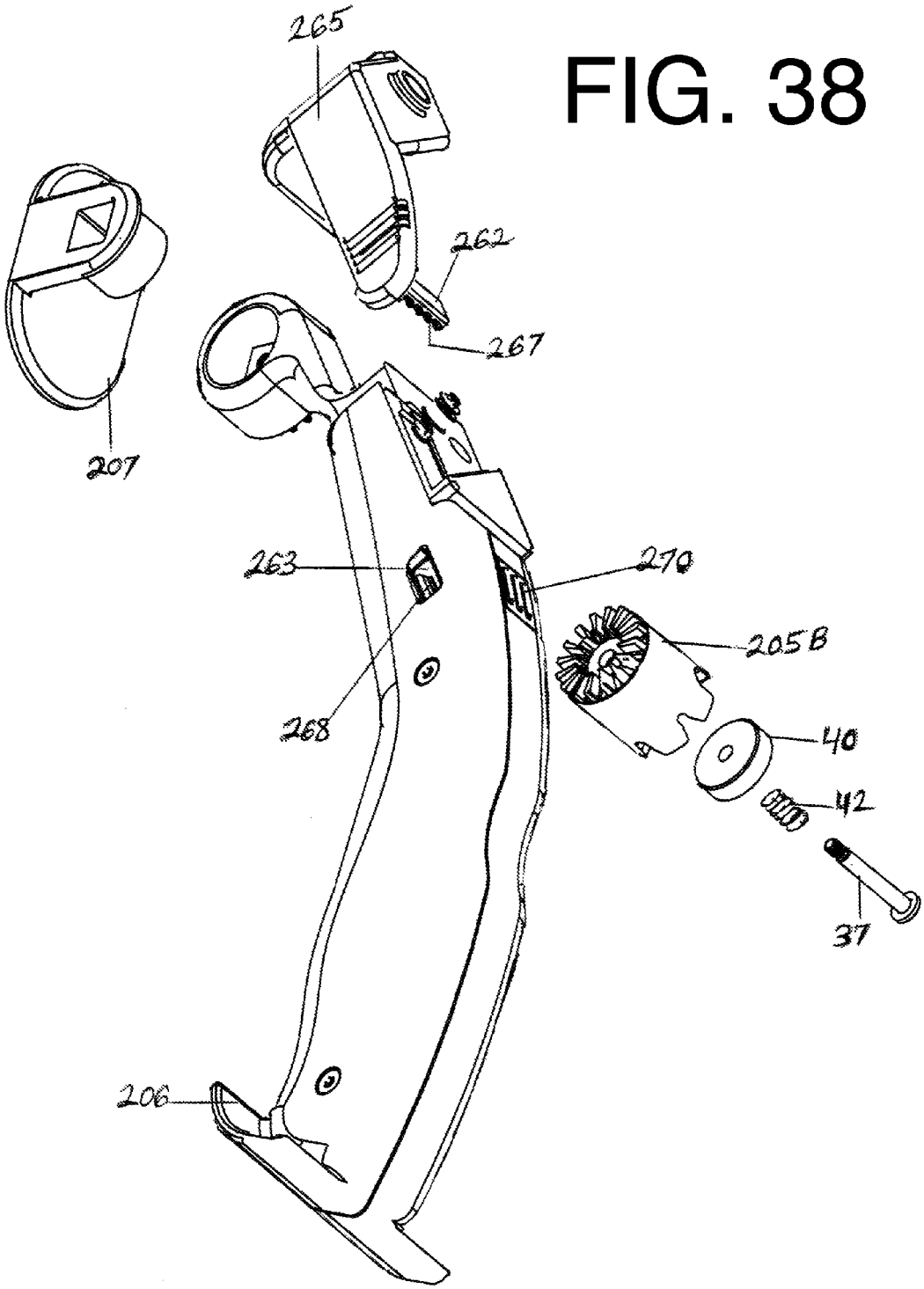
FIG. 38 is a top left perspective view of a standalone tool having separate front and rear stabilizers and a nonfunctional clip in place of a resilient crossover arm, with the front stabilizer, nonfunctional clip and fastener holding member assembly exploded.

In addition to, or instead of, holding the fastener 2 within the fastener holding member 205 using magnetic attraction, in certain embodiments of the invention an opposing and preferably movable surface is provided, e.g., to close off the notches 45 after the fastener 2 has been placed into a suitable pair of them. According to one embodiment, e.g., illustrated in FIGS. 36-39, a resilient crossover arm 260 provides such a movable surface 261. As shown, resilient crossover arm 260 includes a tab 262 that fits into a corresponding opening 263 within the handle 202 of tool 200. Upon disengaging tab 262 from opening 263, surface 261 can be flexed outwardly and upon inserting tab 262 into opening 263, surface 261 can be clamped over the distal end of fastener holding member 205. Preferably, resilient crossover arm 260 is made of plastic, but instead could be made of any other resilient material. In the current embodiment, protruding section 266 (which fits into the interior of the cylindrically shaped fastener holding member 205) also is provided at the distal end 264 of resilient crossover arm 260. However, in alternate embodiments the inner surface of distal end 264 is substantially flat. Because crossover arm 260 is resilient it can be easily attached to and detached from tool 200, e.g., as shown in FIG. 36. Also, when resilient crossover arm 260 is not desired, it can be removed and replaced with a nonfunctional clip 265, e.g., as shown in FIG. 38. Although resilient crossover arm 260 is shown crossing over the top of the tool 200 in the current embodiment, in alternate embodiments it instead could cross the bottom of the tool or intersect the mid-portion of the body of the handle 202 itself.

In certain embodiments, the tab 262 of the resilient crossover arm 260 and/or the nonfunctional clip 265 is provided with a mating surface 267 (here, a set of parallel ridges) that mates with a corresponding mating surface 268 (here, another set of one or more parallel ridges) within opening 263, thereby locking crossover arm 260 into position. In such a case, a release mechanism 270 (here, a spring-biased or otherwise resiliently biased button) preferably also is provided on handle 202 which, when activated, separates the mating surfaces to allow tab 262 to be more easily withdrawn from opening 263. For instance, in the present embodiment button 270 is mechanically coupled to mating surface 268 such that when button 270 is depressed, mating surface 268 also is forced downwardly and out of engagement with mating surface 267. Upon releasing button 270, the spring biasing returns button 270 to its default position. This is shown most clearly in FIG. 39B, in which the left side 202A of handle 202 has been exploded out in order to show the release mechanism, which primarily is within the handle's right side 202B.

In alternate embodiments, surface 261 can be provided through any of a variety of other types of mechanisms and/or structures. Examples include using an arm (e.g., an elongated, preferably rigid structure) that is pivotally or slidably attached (e.g., permanently) to the body of tool 200, so that surface 261 can be pivoted or slid into or out of position as and when desired, rather than having to remove and install a separate component.

Figure 39A:
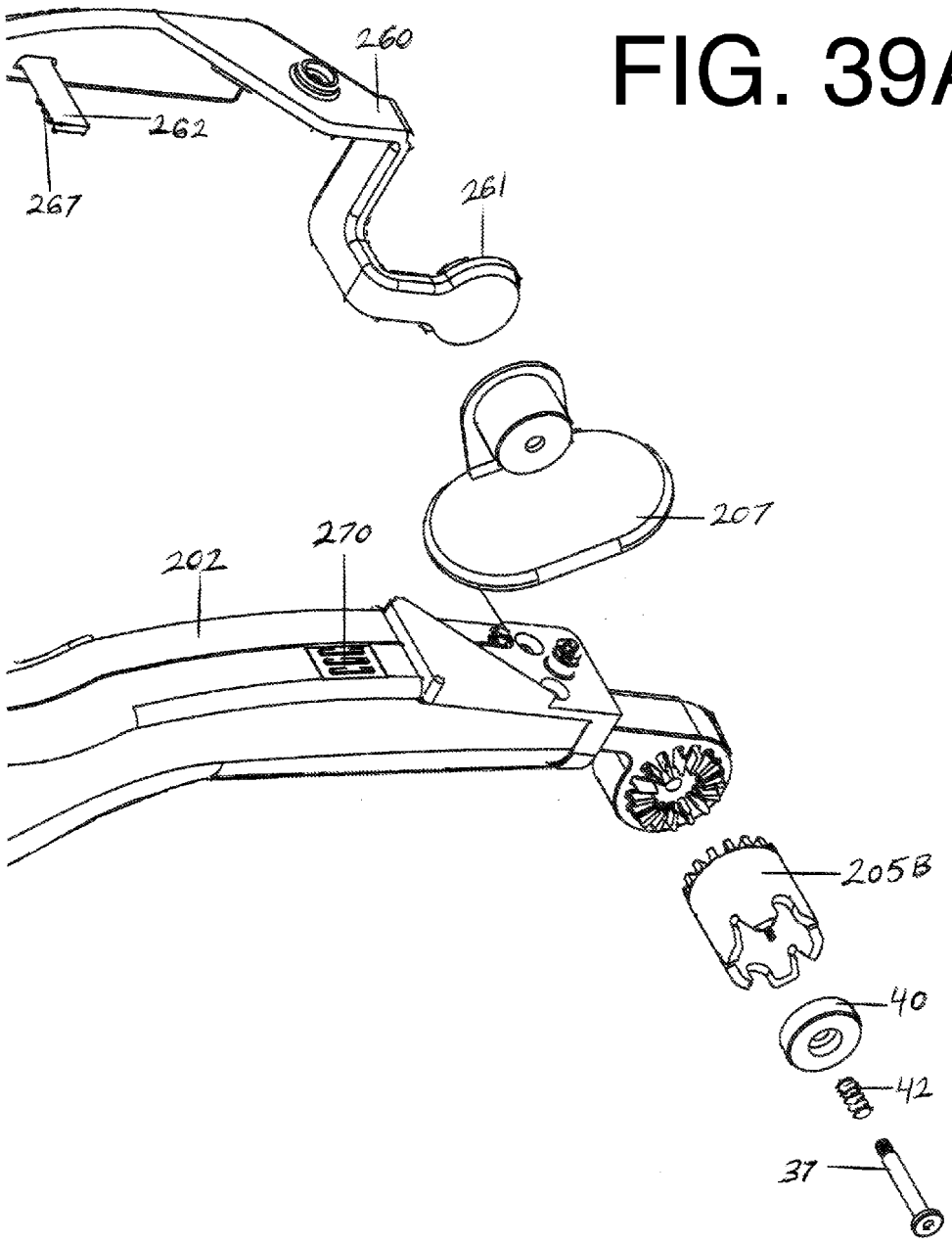
FIG. 39A is a top right perspective view of the front portion of a standalone tool having a separate front stabilizer and a resilient crossover arm, with the front stabilizer, resilient crossover arm and fastener holding member assembly exploded.
Figure 39B:
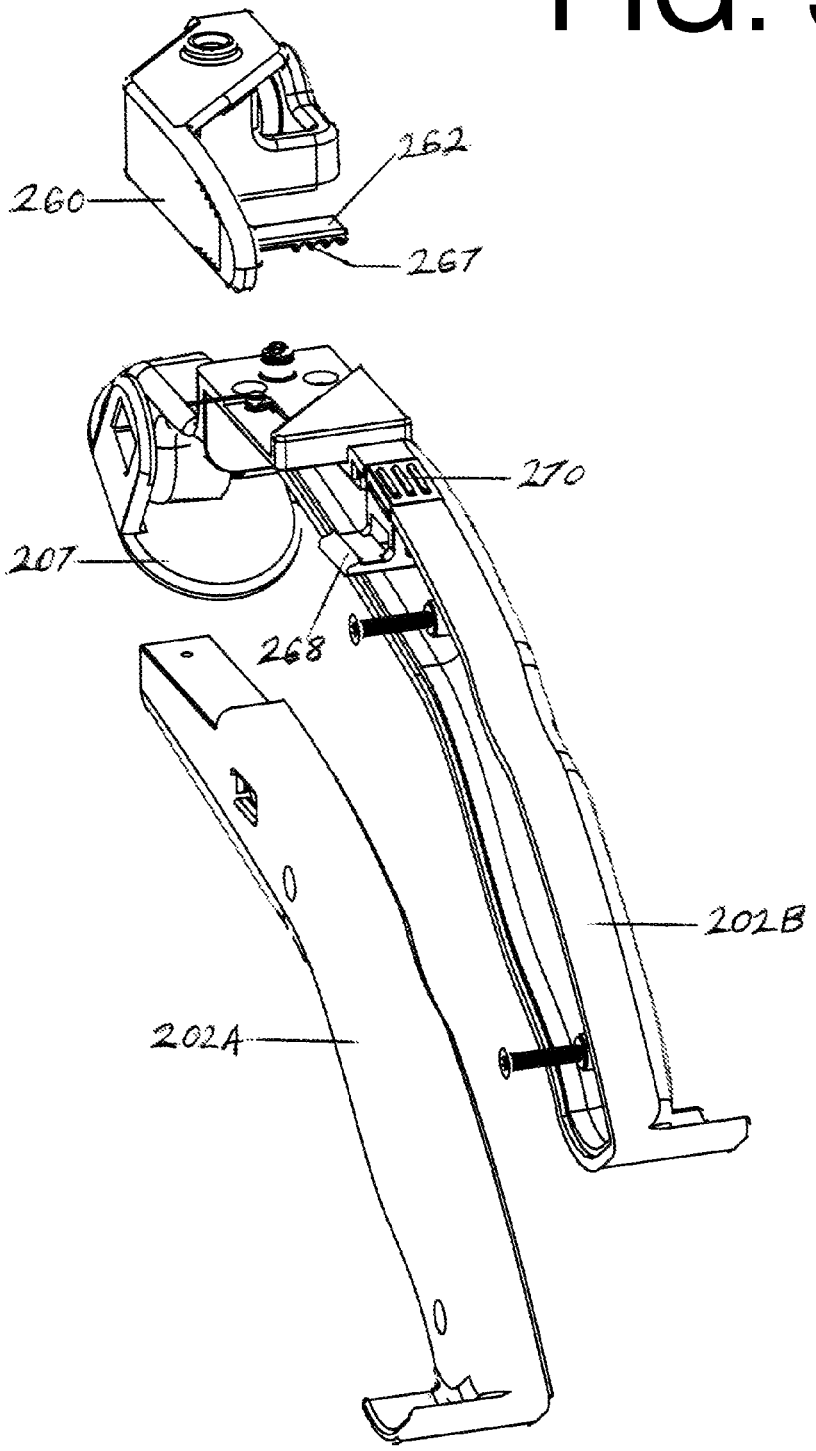
FIG. 39B is a top left perspective view of a standalone tool having a separate front stabilizer and a resilient crossover arm, with the resilient crossover arm and left side of the handle exploded out to better illustrate the operation of the release mechanism.

The preceding discussion focuses on various features of tool 200. However, it should be understood that these specific configurations can vary from embodiment to embodiment. For example, FIGS. 38 and 39A illustrate a particular embodiment in which screw 37 is inserted from, and spring 42 is disposed on, the right side of tool 200 (or the same side from which fastener holding member 205 extends), with screw 37 attaching both fastener holding member 205B (which includes three pairs of notches 45) and distal-end stabilizer 207. Alternatively, in FIG. 30 screw 37 and spring 42 are inserted from, and disposed on, the left side of tool 200 (or the opposite side from which fastener holding member 205 extends) and attaches a fastener holding member 205 (which includes two pairs of notches 45).

Figure 40:
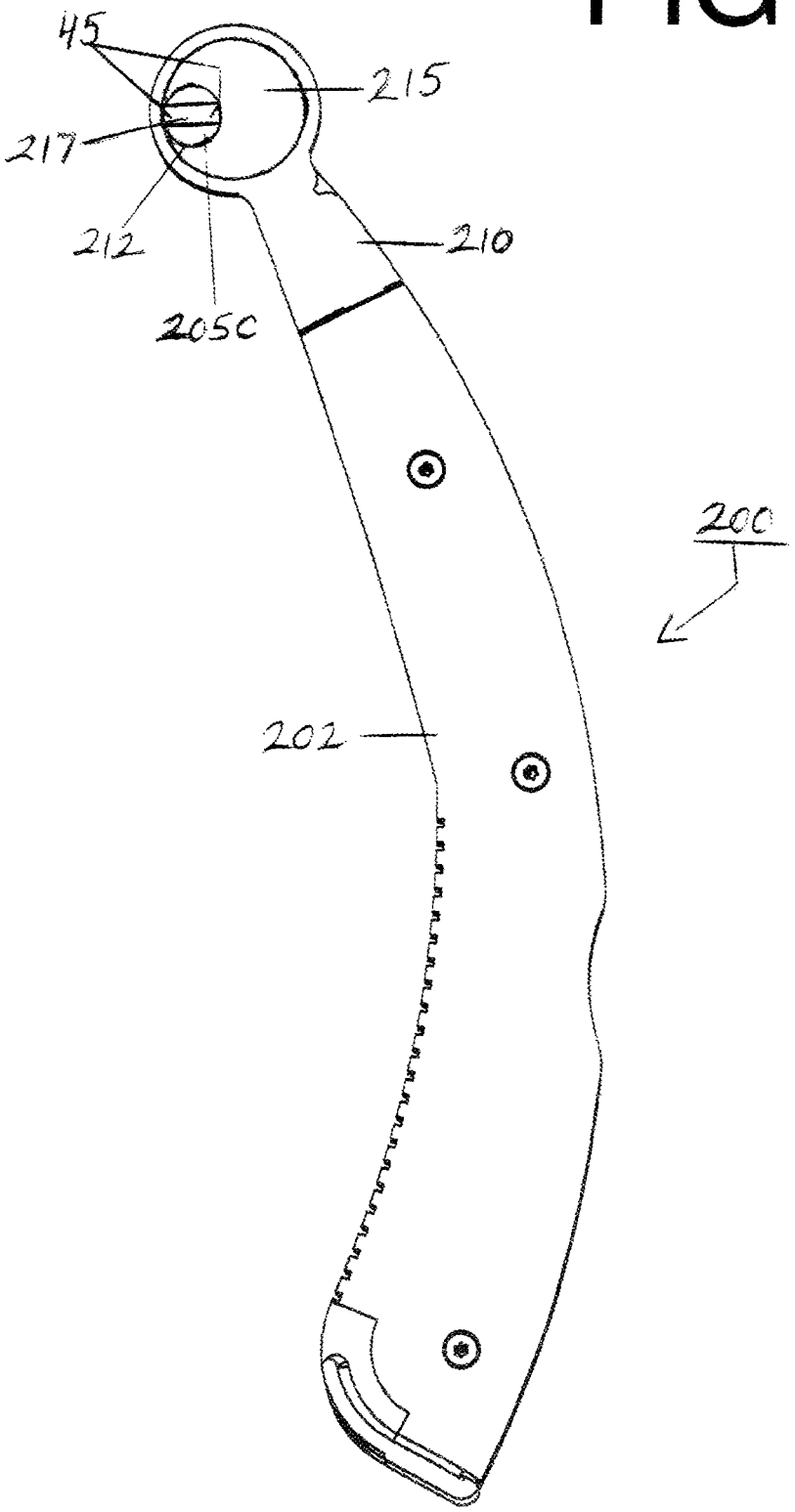
FIG. 40 is a left side elevational view of a standalone tool having a smaller, offset fastener holding member.
Figure 41:
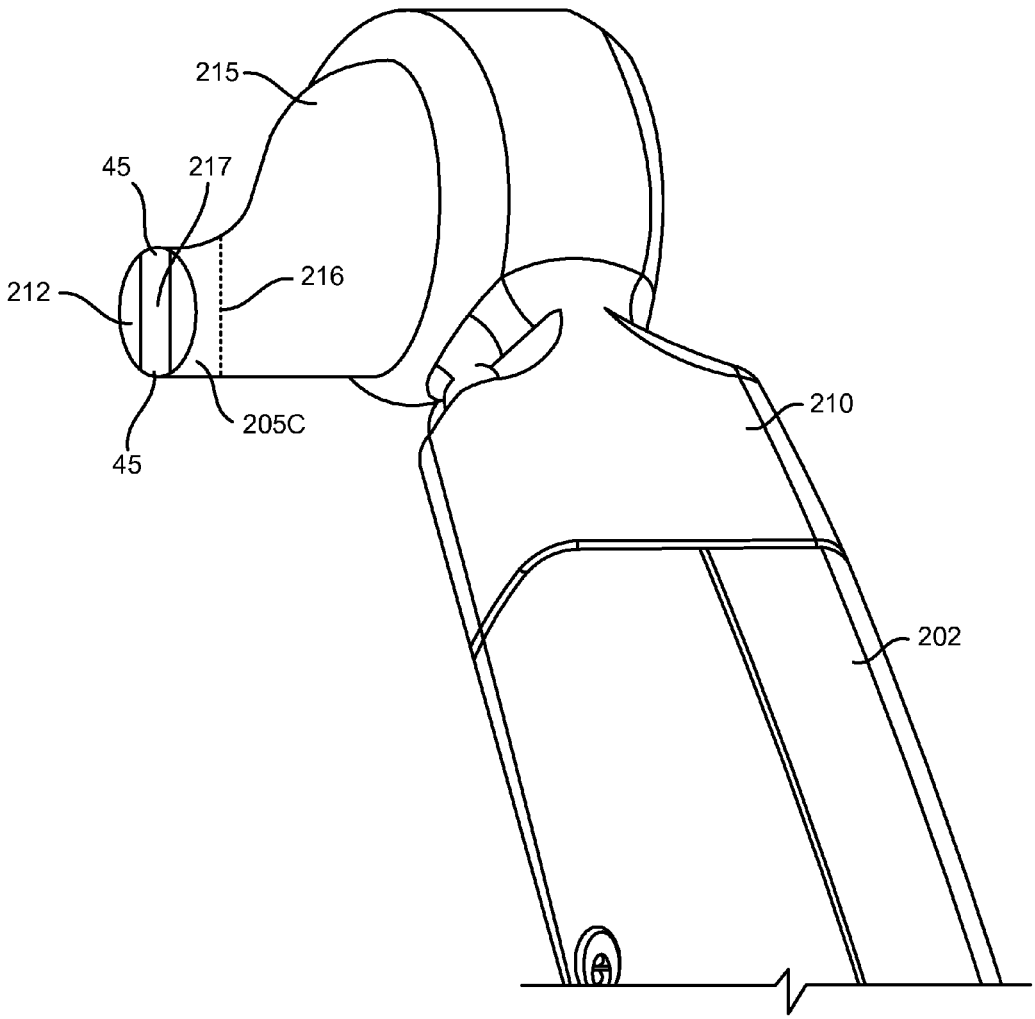
FIG. 41 is a top left perspective view of the front portion of a standalone tool having a smaller, offset fastener holding member.

According to another variation, shown in FIGS. 40 and 41, tool 200 includes a fastener holding member 205C having a distal end 212 that is smaller and offset from the center, e.g., so that it can be placed closer to the wall or other surface into which the fastener 2 is to be inserted. Such a fastener holding member 205C is well-suited for very short fasteners 2. As with the preceding embodiments, the entire structure 215 that includes fastener holding member 205C may be rotatably attached to the remainder of tool 200. Rotating the entire structure 215 would cause the locations of notches 45, as well as their angular orientation relative to each other and their distances from the wall or other surface into which fastener 2 is to be inserted, to vary. Accordingly, fastener holding member 205C instead (or also) may be attached to the rest of structure 215 (e.g., along plane 216) using a screw-and-spring assembly such as described above for attaching fastener holding member 205 or 205B to the remainder of tool 200. As a result, fastener holding member 205C could be pulled outwardly and rotated relative to the rest of structure 215 in a similar manner, thereby allowing notches 45 to be rotated while still remaining close to the wall or other surface into which fastener 2 is to be inserted.

FIGS. 40 and 41 also illustrates another concept. In the preceding examples, one or more pairs of notches 45 are disposed on opposite sides of the corresponding fastener holding member, which in turn has a central opening (so that only a peripheral edge is present at the distal end of the fastener holding member). In the present embodiment, the distal end is solid and the opposite notches are connected via a central channel 217, so they are not separately distinguishable from each other. In other words, in the preferred embodiments, notches are provided on opposite sides of the distal end of the fastener holding member, but it is generally less important what is in between such notches. In any event, it is generally preferred for the pair of notches (or other openings) used to accommodate a faster 2 to be at least ⅛ inch and, more preferably, at least ¼ inch apart.

Figure 42:
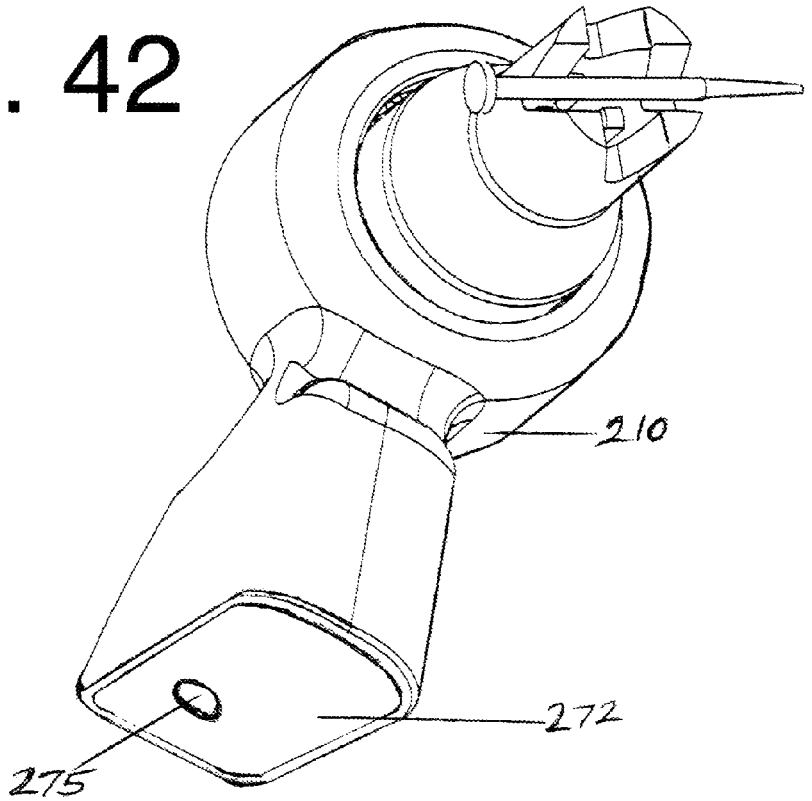
FIG. 42 is a top right perspective view of the front portion of a standalone tool with its head portion removed.
Figure 42:
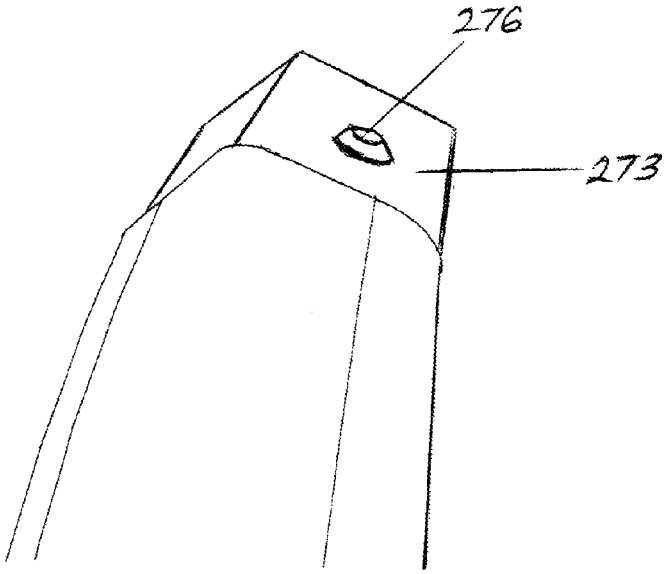
Figure 43:
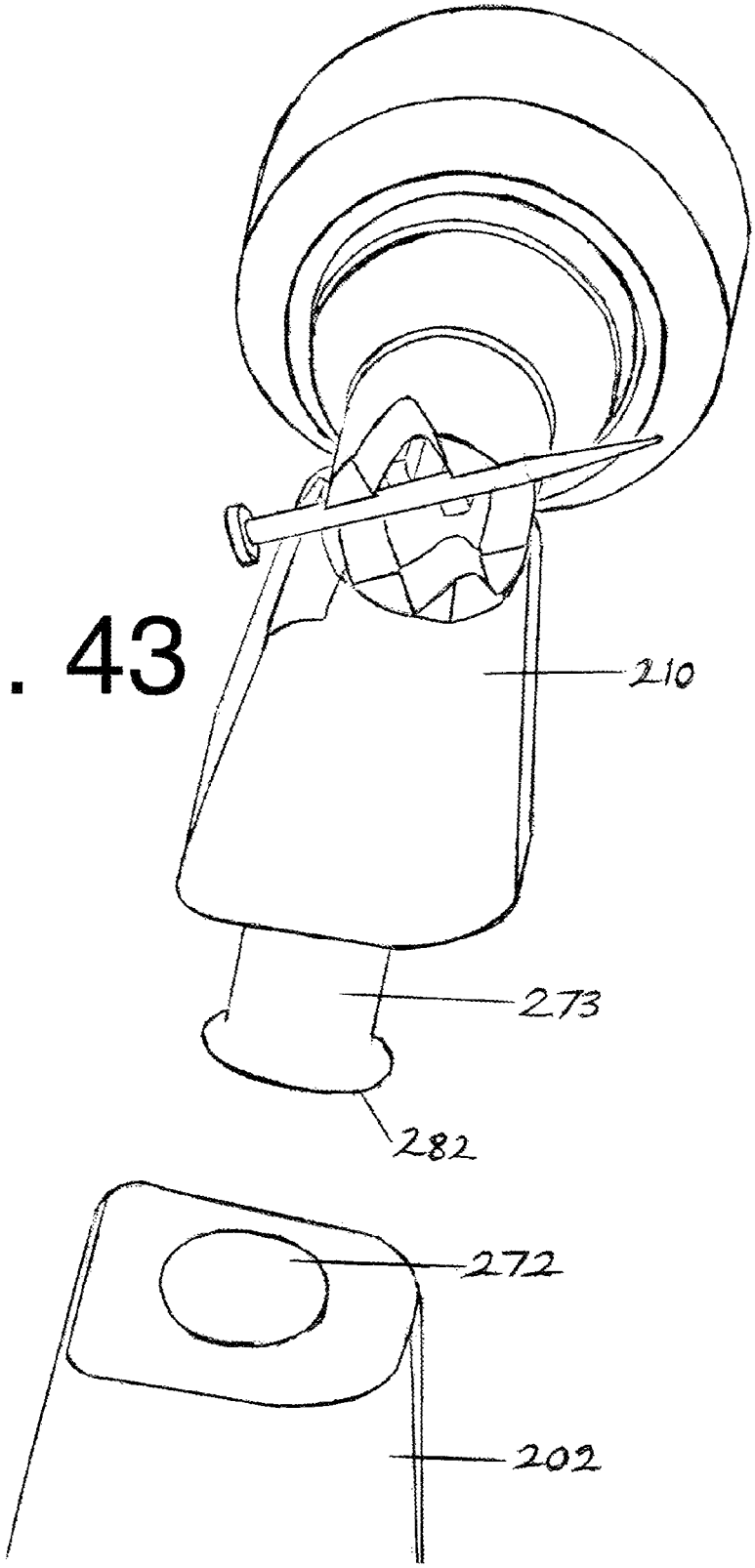
FIG. 43 is a right side perspective view of the front portion of a standalone tool with its head portion removed.
Figure 44:
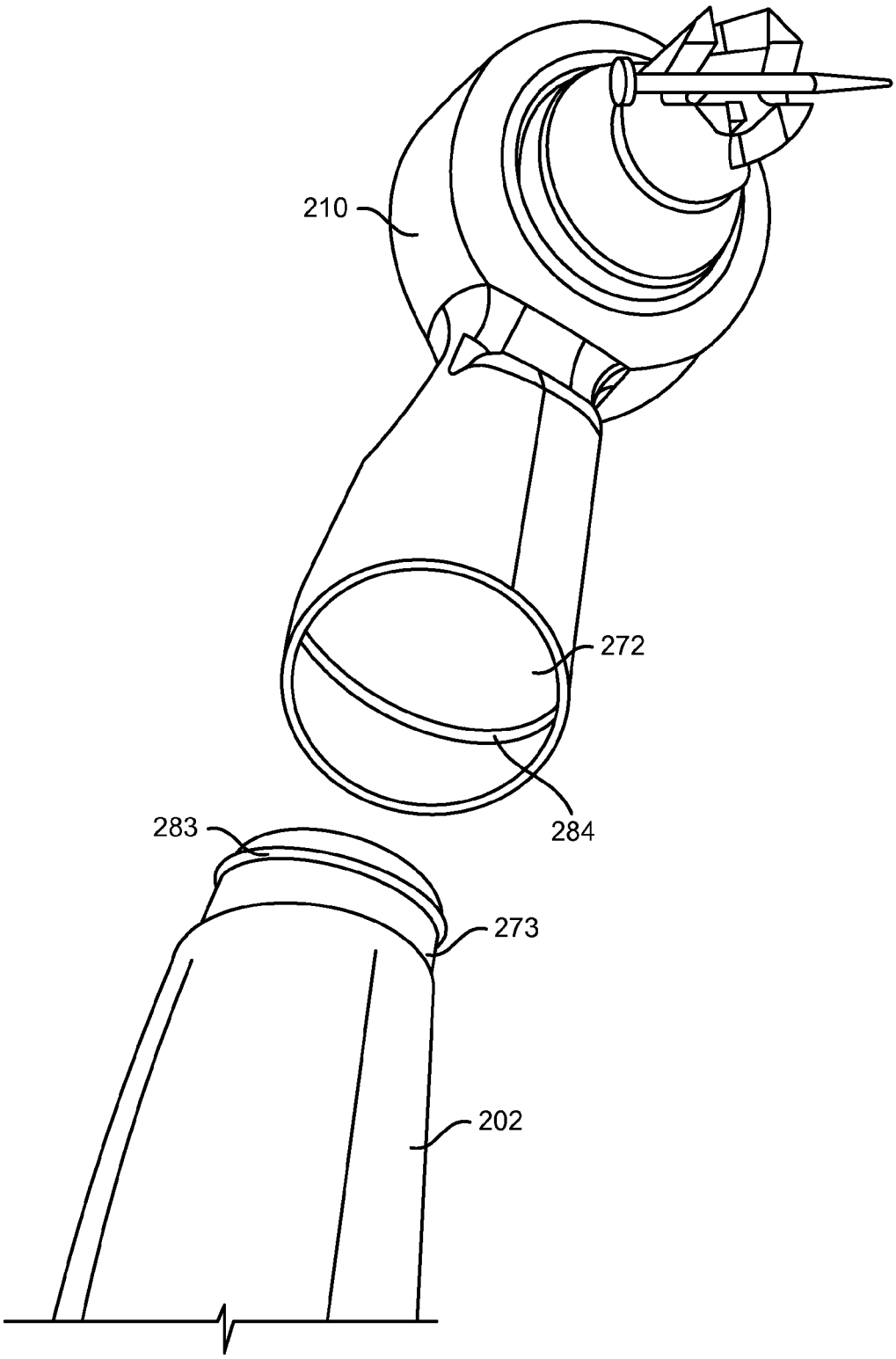
FIG. 44 is a right side perspective view of the front portion of a standalone tool with its head portion removed.

In the foregoing discussion, one particular structure for allowing head portion 210 to be rotated relative to handle 202 was discussed. Other embodiments can employ other structures. For instance, in one alternate set of embodiments (such as are shown in FIGS. 42-44, the entire head portion 210 can be removed from handle 202, rotated to a desired orientation, and then reattached to handle 202 at that rotational orientation. In these embodiments, typically one of the components (i.e., handle 202 and the head portion 210) has an opening 272 and the other has an insertion member 273 that fits into the opening 272.

In one such specific embodiment, as shown in FIG. 42, the head portion 210 includes an opening 272 that opens into a hollow space in its proximal end, and the handle 202 includes a matching insertion member 273 at its distal end. Inside of opening 272, on the inner wall, is one or more small indentations 275, and insertion member 273 includes one or more matching resilient or spring-loaded protrusions 276 on its outer surface that fit into such indentations 275, thereby providing a snap fit between handle 202 and head portion 210. In the current embodiment, a pair of such indentations 275 is provided, one on the left side and one on the right side of the head portion 210 and, similarly, a pair of the protrusions 276 is provided on insertion member 273, one on the left side and one on the right side of the handle 202. As a result, head portion 210 can lock into position such that fastener holding member 205 extends to the left side of tool 200, or it can lock into position such that fastener holding member 205 extends to the right side of tool 200.

In certain embodiments, opening 272 and insertion member 273 are both rectangularly shaped, so that it is only possible to attach head portion 210 to handle 202 at two different angular orientations (such as the foregoing, so that fastener holding member 205 only extends to the left side or to the right side of tool 200), e.g., separated by 180°. In other embodiments, the two components have a square cross-section, so that four angular orientations are possible (in which case, four indentations 275 preferably are provided, one on each interior wall).

In still further embodiments, the insertion member 273 is provided at the proximal end of the head portion 210, and the opening 272 is provided at the distal end of the handle 202. One advantage of this alternate configuration is that the entire handle 202 can then be made hollow, thereby providing a space for storing fasteners 2 and/or other items. Similarly, the indentations 275 and protrusions 276 can be provided on either or both of the handle 202 and/or the head portion 210, and/or any other locking mechanism may be provided for securing the head portion 210 to the handle 202. However, such locking or mating preferably is only temporary (e.g., relatively easily releasable) so that head portion 210 can be separated from handle 202 whenever desired, e.g., by applying sufficient force (e.g., as in the current embodiment shown in FIG. 41) and/or by activating a release mechanism. Where provided, indentations 275 may extend through just a portion of the wall or other part of their respective components, or instead may extend all the way through (i.e., so that they are implemented as holes).

According to somewhat modified variation, e.g., as shown in FIG. 43, the entire head portion 210 is again removable and replaceable at different angular orientations. However, in this case there is not a relatively small, fixed number of possible angular orientations, but instead head portion 210 can be installed at any arbitrary rotational position onto handle 202. In the embodiment shown in FIG. 43, head portion 210 has an insertion member 273 extending from its proximal end, and handle 202 has an opening 272 at its distal end. As shown, in this embodiment insertion number 273 has a circular cross-section, with an enlarged segment 282 (preferably having rounded edges) at its very end, and opening 272 also is circular with a slightly smaller diameter than that of enlarged segment 282, so that enlarged segment 282 tightly fits within opening 272. Preferably, either or both of enlarged segment 282 and/or opening 272 are resilient, so that a friction fit is provided when insertion member 273 is inserted into opening 272. As a result of this configuration, head portion 210 generally can be rotated to any desired arbitrary angular orientation and then inserted (e.g., pressed) into handle 202. Later, the two components can be pulled apart when desired, e.g., to rotate head portion 210 to a different angular orientation. Once again, in this embodiment, all or any portion of handle 202 may be made hollow so that the resulting compartment can be used for storage. However, in an alternate embodiment insertion member 273 is provided at the distal end of handle 202 and opening 272 is provided in the proximal end of head portion 210.

Various other embodiments also are possible. For instance, as shown in FIG. 44, the proximal end of the head portion 210 and the distal end of the handle 202 both have a circular cross-section. More specifically, in this embodiment, the opening 272 is circular and is in the proximal end of the head portion 210, while the insertion member 273 (also circular) is at the distal end of the handle 202. A snap fit is provided when circular resilient ridge 283 along the outer surface of insertion member 273 mates with groove 284 in the inner wall of head portion 210. It is noted that in any of the embodiments, the insertion member 273 also may be provided with an open end. Such a feature in the present embodiment, e.g., would allow storage within handle 202, similar to certain other embodiments discussed above. Alternatively, or in addition, opening 272 could be provided at the distal end of handle 202 and insertion member 273 provided at the proximal end of head portion 210. In any event, this particular configuration also can provide for arbitrary selection of the angle of attachment.

Generally speaking, the insertion member 273 and opening 272 can have any desired shape to accomplish any desired purpose. For instance, if both have a cross-section in the shape of a regular N-sided polygon, the two components can mate at any of up to N different angular orientations, where N can be any integer that is 3 or larger, although a multiple of 4 often will be preferred. Similarly, a friction fit and/or a locking mechanism can be used in any embodiment to secure the two components together. Still further, it should be noted that any of the mechanisms described herein for attaching head portion 210 to handle 202 also can be used to attach any of the fastener holding members discussed herein to another component of the overall tool, and vice versa. Also, in some of the embodiments discussed above, the head portion 210 is described as remaining attached to the handle 202 (e.g., via spring biasing) while it is being rotated to a different angular orientation, and in others it is described as completely detaching for that purpose; however, these descriptions are merely exemplary, and it should be noted that in any of the embodiments (e.g., with any of the various mating configurations), either such configuration can be used (e.g., depending upon user preference).

Figure 45:
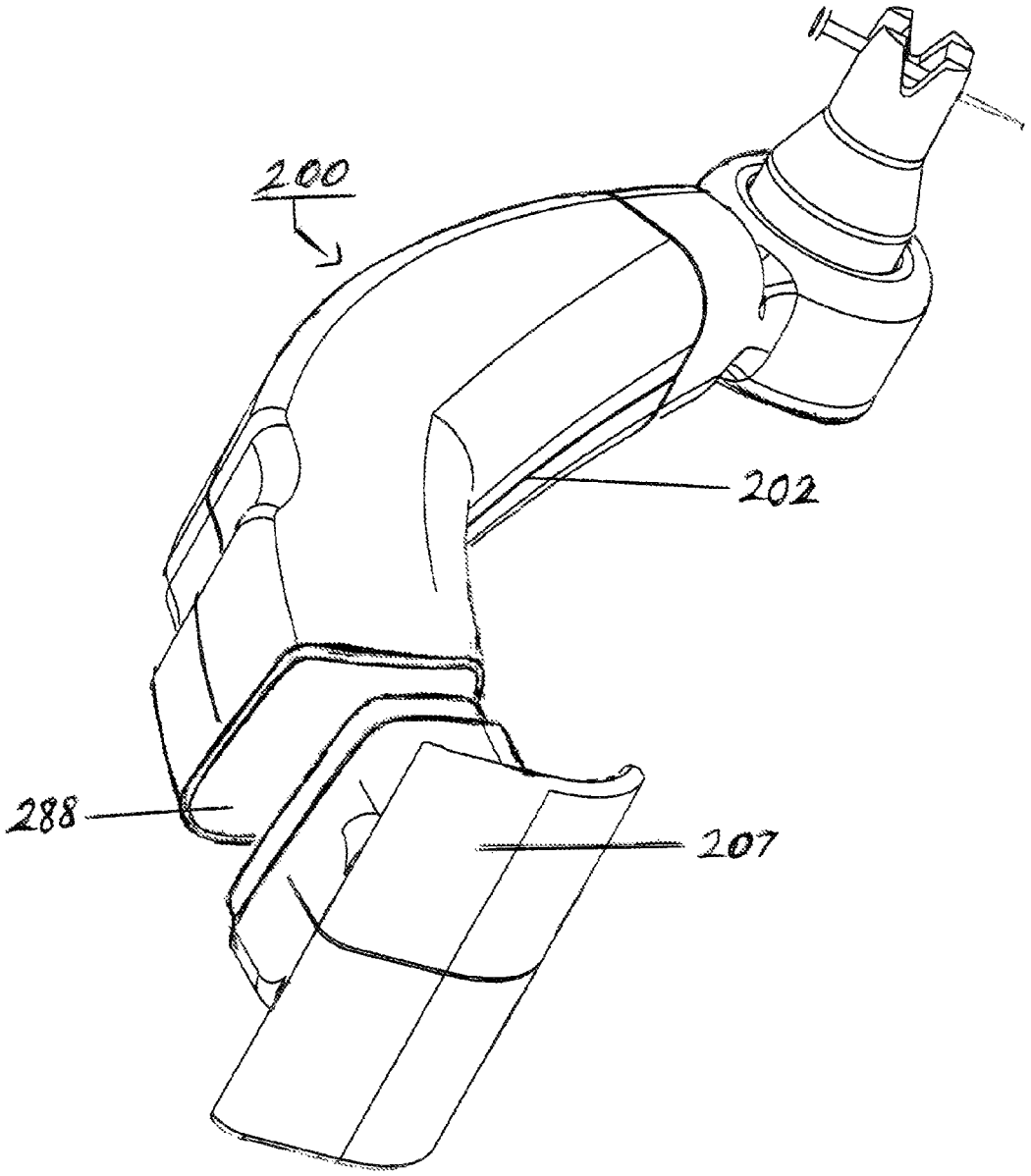
FIG. 45 is a right side perspective view of a standalone tool with its rear portion removed.

One further variation is shown in FIG. 45. Here, tool 200 includes a removable rear portion 287 which, in the present embodiment, includes a rear stabilizer 207. One advantage of such a structure is that it can expose an opening 288 into handle 202, allowing the user to store fasteners 2 or other items within a cavity and the interior of handle 202. Another advantage is that it can provide for easy replacement of stabilizer 207, e.g., with a different stabilizer (e.g., flat, curved a different manner or attached in a different manner. For instance, one could decide to replace a fixedly attached stabilizer with one that is pivotally attached, or vice versa. Also, a replacement piece can be provided, e.g., as or in the shape of: (1) a hammer claw for the purpose of prying or removing nails or other fasteners; (2) a caulk/putty dispenser; (3) stud finder/detector (e.g., magnetic or internal capacitor) for the purpose of locating wood or metal elements beneath the surface or substrate; and/or (4) a light that illuminates the point of contact where the fastener is placed while tool 200 is in use. In alternate embodiments, any of such items may be permanently attached to the handle 202 (typically, at the proximal end). When the tool 200 is provided with or configured for accommodating such a claw, the claw itself and typically the overall tool 200 preferably is strong enough for the intended purpose, e.g., made of steel and/or reinforced.

Multi-Tool Embodiments

In the embodiments discussed above, the existing tool is an adjustable wrench 6. However, a variety of styles of wrenches or other tools can be used in conjunction with a device according to the present invention. For example, in one embodiment a wrench or other tool incorporating a device according to the present invention has: i) lights along the handle to aid the user in visualizing where the fastener 2 is going to be placed; ii) a padded handle for extra comfort and grip; iii) a claw disposed at its base for removing nails, e.g., similar to the claw at the head of a conventional hammer (which claw may be integral with the tool or attached by one or more screws, nuts, bolts, and/or washers); iv) a handle with magnets strategically placed along its shaft to provide areas of storage for metal objects such as nails, screws nuts, bolts and washers; v) a handle with a nail pry bar attached by means of strategically placed magnets; vi) a magnetic or internal capacitor stud-finder attached to its base; vii) a handle having a compartment to hold miscellaneous objects (such as nails, screws, nuts or the like); viii) a caulk/putty dispenser; and/or ix) an ergonomic handle to maximize ease of use. The specific shape of the multi-tool handle may, e.g., be the same as the ergonomic stand-alone device discussed above in connection with FIG. 23.

Additional Considerations.

In the event of any conflict or inconsistency between the disclosure explicitly set forth herein or in the attached drawings, on the one hand, and any materials incorporated by reference herein, on the other, the present disclosure shall take precedence. In the event of any conflict or inconsistency between the disclosures of any applications or patents incorporated by reference herein, the disclosure having the most recent priority date shall take precedence.

Unless clearly indicated to the contrary, words such as "optimal", "optimize", "minimize", "best", as well as similar words and other words and suffixes denoting comparison, in the above discussion are not used in their absolute sense. Instead, such terms ordinarily are intended to be understood in light of any other potential constraints, such as user-specified constraints and objectives, as well as cost and processing constraints.

In the above discussion, certain methods are explained by breaking them down into steps listed in a particular order. However, it should be noted that in each such case, except to the extent clearly indicated to the contrary or mandated by practical considerations (such as where the results from one step are necessary to perform another), the indicated order is not critical but, instead, that the described steps can be reordered and/or two or more of such steps can be performed concurrently.

References herein to a "criterion", "multiple criteria", "condition", "conditions" or similar words which are intended to trigger, limit, filter or otherwise affect processing steps, other actions, the subjects of processing steps or actions, or any other activity or data, are intended to mean "one or more", irrespective of whether the singular or the plural form has been used. For instance, any criterion or condition can include any combination (e.g., Boolean combination) of actions, events and/or occurrences (i.e., a multi-part criterion or condition).

Similarly, in the discussion above, functionality sometimes is ascribed to a particular module or component. However, functionality generally may be redistributed as desired among any different modules or components, in some cases completely obviating the need for a particular component or module and/or requiring the addition of new components or modules. The precise distribution of functionality preferably is made according to known engineering tradeoffs, with reference to the specific embodiment of the invention, as will be understood by those skilled in the art.

In the discussions above, the words "include", "includes", "including", and all other forms of the word should not be understood as limiting, but rather any specific items following such words should be understood as being merely exemplary.

Several different embodiments of the present invention are described above and in the documents incorporated by reference herein, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

Thus, although the present invention has been described in detail with regard to the exemplary embodiments thereof and accompanying drawings, it should be apparent to those skilled in the art that various adaptations and modifications of the present invention may be accomplished without departing from the spirit and the scope of the invention. Accordingly, the invention is not limited to the precise embodiments shown in the drawings and described above. Rather, it is intended that all such variations not departing from the spirit of the invention are to be considered as within the scope thereof as limited solely by the claims appended hereto.

What is claimed is:

1. An apparatus for holding a fastener, comprising:

a main body structure; and a fastener holding member having a proximal end that is rotatably attached to said main body structure, such that said fastener holding member is capable of rotating relative to said main body structure around a rotation axis, and having a distal end that includes a pair of notches on opposite sides of said rotation axis, said notches being sized and shaped to accommodate a fastener, said fastener being at least one of a nail or a screw, wherein when said fastener is placed within the notches, so as to extend between the notches, said fastener intersects the rotation axis at a location between the notches, and wherein said fastener holding member extends laterally and substantially perpendicularly away from said main body structure.

2. An apparatus according to claim 1, wherein said fastener holding member is capable of locking into position at different rotational orientations relative to said main body structure.

3. An apparatus according to claim 2, wherein said fastener holding member is attached to said main body structure via a spring which presses mating members on an inner surface of said fastener holding member against corresponding mating members that are attached to said main body structure.

4. An apparatus according to claim 3, wherein said main body structure includes a handle and a pair of jaws, and wherein said fastener holding member and said corresponding mating members are part of an assembly that is fixedly but detachably attached to one of said jaws.

5. An apparatus according to claim 1, wherein said fastener holding member also includes a second pair of notches on opposite sides of said rotation axis, said notches of said second pair also being sized and shaped to accommodate a fastener that comprises at least one of a nail or a screw.

6. An apparatus according to claim 5, wherein the notches of said second pair are sized and shaped to accommodate a different-sized fastener than the notches of said pair.

7. An apparatus according to claim 5, wherein said pair of notches and said second pair of notches are: (a) disposed on a perimeter of the distal end of said fastener holding member; and (b) angularly offset from each other.

8. An apparatus according to claim 1, further comprising a movable opposing surface that can be manually positioned adjacent to an outer surface of said fastener holding member in order to assist in securing the fastener within said notches.

9. An apparatus according to claim 8, wherein said movable opposing surface comprises additional notches that match said notches of said pair.

10. An apparatus according to claim 1, further comprising a steadying surface, adjacent to said fastener holding member and angled relative to a line between the notches of said pair, which can be pressed against an external surface into which the fastener is to be inserted in order to steady said apparatus during use.

11. An apparatus according to claim 10, wherein said steadying surface is capable of pivoting relative to said fastener holding member.

12. An apparatus according to claim 10, wherein said steadying surface is a substantially flat, planar surface.

13. An apparatus according to claim 10, further comprising a second steadying surface, disposed at an opposite end of said main body structure, which also can be pressed against said external surface into which the fastener is to be inserted in order to further steady said apparatus when in use.

14. An apparatus according to claim 1, wherein said fastener holding member is attached to a distal end of said main body structure, wherein said main body structure has an opposite, proximal end, and wherein said main body structure is curved between said proximal end and said distal end along a plane that is substantially perpendicular to a central axis of said fastener holding member.

15. An apparatus according to claim 1, wherein said main body structure includes a head portion at a distal end of said main body structure, wherein the fastener holding member is attached to the head portion, and wherein the head portion is capable of being rotated into different angular orientations relative to a remainder of said main body structure.

16. An apparatus according to claim 15, wherein said head portion is capable of locking into position at said different angular orientations.

17. An apparatus according to claim 1, wherein said fastener holding member is cylindrically shaped.

18. An apparatus according to claim 1, wherein said distal end of said fastener holding member is smaller and is offset from center, as compared to the proximal end of said fastener holding member.

19. An apparatus according to claim 1, wherein the fastener holding member is part of a larger structure that is pivotally attached to the main body structure.

20. An apparatus according to claim 19, wherein the fastener holding member is capable of being rotated to different angular orientations relative to the main body structure.

21. An apparatus according to claim 1, wherein the proximal end of said fastener holding member includes a first ridge pattern that meshes with a second ridge pattern on said main body structure, permitting said fastener holding member and said main body structure to be locked into different angular orientations relative to each other.

22. An apparatus according to claim 21, wherein said fastener holding member and said main body structure are spring-biased toward each other.

23. An apparatus according to claim 1, wherein said fastener holding member is substantially cylindrically shaped.

* * * * *